US011707393B2

(12) United States Patent
Wiggermann et al.

(10) Patent No.: US 11,707,393 B2
(45) Date of Patent: Jul. 25, 2023

(54) METHODS OF PREPARING A SUBJECT FOR ROTATION AND ROTATING A SUBJECT USING AN OVERHEAD LIFT

(71) Applicant: LIKO RESEARCH & DEVELOPMENT AB, Luleå (SE)

(72) Inventors: Neal Wiggermann, Batesville, IN (US); Michael Buccieri, Greenfield, IN (US); Alejandro Noe Conejo Castaño, Batesville, IN (US); Morgan Dreyer, Versailles, IN (US); Jie Zhou, Batesville, IN (US); Lori Ann Zapfe, Milroy, IN (US)

(73) Assignee: LIKO RESEARCH & DEVELOPMENT AB, Luleå (SE)

( * ) Notice: Subject to any disclaimer, the term of this patent is extended or adjusted under 35 U.S.C. 154(b) by 103 days.

(21) Appl. No.: 17/164,639

(22) Filed: Feb. 1, 2021

(65) Prior Publication Data

US 2021/0251834 A1 Aug. 19, 2021

Related U.S. Application Data

(60) Provisional application No. 62/978,420, filed on Feb. 19, 2020.

(51) Int. Cl.
*A61G 7/10* (2006.01)

(52) U.S. Cl.
CPC ..... *A61G 7/1051* (2013.01); *A61G 7/1017* (2013.01); *A61G 2200/325* (2013.01);
(Continued)

(58) Field of Classification Search
CPC .... A61G 7/001; A61G 7/1015; A61G 7/1017; A61G 7/1042; A61G 7/1051;
(Continued)

(56) References Cited

U.S. PATENT DOCUMENTS 33,545 A * 10/1861 Ruth ..... A61G 7/1015 5/85.1
2,376,560 A * 5/1945 Smith ..... A61G 7/1067 212/343
(Continued)

FOREIGN PATENT DOCUMENTS

EP 3064183 A1 9/2016
EP 3424478 A1 * 1/2019
(Continued)

OTHER PUBLICATIONS

"RotoProne Bed—Life Support." YouTube, uploaded by chesapoo, Mar. 28, 2017, https://www.youtube.com/watch?v=qP25GJg_eRM.
(Continued)

*Primary Examiner* — David R Hare
*Assistant Examiner* — Alexis Felix Lopez
(74) *Attorney, Agent, or Firm* — Dinsmore & Shohl LLP

(57) ABSTRACT

A method of rotating a subject includes arranging a lifting aid underneath the subject such that a midline of the subject is off center from a centerline of the lifting aid in a direction opposite of the rotation direction. The lifting aid includes a first loop extending in the rotation direction and a second loop extending in the opposite direction. The method further includes connecting the loops to a sling bar coupled to an overhead lift and directing the overhead lift to raise, where the subject rotates towards the direction of rotation due to the off center location of the subject. The method further includes repositioning the subject when the subject has rotated to a lateral recumbent position and directing the overhead lift to lower, thereby causing the subject to continue rotating.

20 Claims, 17 Drawing Sheets

(52) U.S. Cl.
CPC .... *A61G 2200/327* (2013.01); *A61G 2203/12* (2013.01); *A61G 2203/20* (2013.01)

(58) Field of Classification Search
CPC .... A61G 13/06; A61G 13/10; A61G 13/1245; A61G 2200/325; A61G 2200/327; A61G 2203/12; A61G 2203/20
See application file for complete search history.

(56) References Cited

U.S. PATENT DOCUMENTS

| | | | | |
|---|---|---|---|---|
| 5,161,267 | A * | 11/1992 | Smith | A61G 7/1046 5/81.1 R |
| 5,235,712 | A | 8/1993 | Smith | |
| 5,263,495 | A | 11/1993 | Butterfield | |
| 5,673,443 | A | 10/1997 | Marmor | |
| 5,946,748 | A | 9/1999 | Wang | |
| 6,560,793 | B2 | 5/2003 | Walker | |
| 8,726,431 | B2 | 5/2014 | Sverdlik et al. | |
| 8,813,276 | B2 * | 8/2014 | Lee | A61G 7/001 5/482 |
| 2005/0055769 | A1 * | 3/2005 | Taylor | A61G 7/1023 5/81.1 T |
| 2005/0132495 | A1 * | 6/2005 | Girard | A62B 1/02 5/89.1 |
| 2006/0185078 | A1 * | 8/2006 | Perry | A61G 7/1023 5/81.1 T |
| 2007/0220671 | A1 * | 9/2007 | Vanderheiden | A61G 7/1046 5/81.1 R |
| 2008/0216232 | A1 | 9/2008 | White et al. | |
| 2014/0000023 | A1 * | 1/2014 | Sverdlik | A61G 7/001 5/81.1 T |
| 2018/0303690 | A1 * | 10/2018 | Hahn | A61G 7/05715 |
| 2018/0318162 | A1 * | 11/2018 | Galbraith | A61G 7/1051 |
| 2020/0060912 | A1 | 2/2020 | Hollabaugh et al. | |

FOREIGN PATENT DOCUMENTS

| | | | | |
|---|---|---|---|---|
| EP | 3838244 | A1 * | 6/2021 | A61G 7/05769 |
| GB | 191509620 | A * | 3/1916 | |
| GB | 2508938 | A | 6/2014 | |
| WO | 2004058126 | A1 | 7/2004 | |
| WO | WO-2016077923 | A1 * | 5/2016 | A45F 3/22 |

OTHER PUBLICATIONS

"Prone Tutorial," YouTube, uploaded by Ardent Red, Jan. 21, 2012, https://www.youtube.com/watch?v=Hd5o4ldp3c0.

"Manual Proning Demonstration," YouTube, uploaded by Mimi Johnson, Jun. 12, 2015, https://www.youtube.com/watch?v=qx2z26lL6g8.

Gattinoni, Luciano et al., "Prone positioning improves survival in severe ARDS: a pathophysiologic review and individual patient meta-analysis." Minerva Anestesioiogica, vol. 76(6) (2010): 448-54.

Extended European Search Report dated Jul. 13, 2021, for EP Patent Application No. 21157151.8. pp. 1-6.

Chinese Office Action corresponding to CN202110174712.5 dated Mar. 4, 2022, 8 pages.

* cited by examiner

METHODS OF PREPARING A SUBJECT FOR ROTATION AND ROTATING A SUBJECT USING AN OVERHEAD LIFT

CROSS-REFERENCE TO RELATED APPLICATION

This application claims priority to U.S. Provisional Patent Application No. 62/978,420, filed Feb. 19, 2020 and entitled "Methods of Preparing a Subject for Rotation and Rotating a Subject Using an Overhead Lift," the entire contents of which is hereby incorporated by reference in its entirety, including the drawings thereof.

BACKGROUND

Field

The present specification generally relates methods of rotating a subject between prone and supine positions and, more specifically, to methods that utilize an overhead lift to facilitate rotation of the subject.

Technical Background

Subjects that are supported by a surface for long periods of time can develop injuries such as pressure ulcers or the like if contact between the subject's body and the surface is not periodically adjusted. One means of adjusting contact is rotating the subject from a prone position to a supine position, and vice versa. In addition, rotating the subject from a prone position to a supine position, and vice versa, may be necessary for the purposes of treating acute respiratory distress syndrome (ARDS). However, some subjects cannot move themselves between positions because of, for example, unconsciousness of the subject, physical deformity of the subject, size of the subject, and/or the like.

Various apparatuses exist to rotate subjects, but such apparatuses tend to be large, unwieldy, not easily transported, expensive, and not readily available. Certain apparatuses that utilize or incorporate overhead lifts are difficult to operate, require a plurality of different forces to be placed on a subject, require a subject to be oriented in a vertical position between prone and supine states, require medical personnel to manually rotate the subject while the subject is supported by the lift, and/or require a subject to be completely suspended from the lift, which presents potential hazards and increased chances of injury. As an alternative, medical personnel use various techniques to rotate a subject from a prone position to a supine position, and vice versa, such as, for example, utilizing bed sheets or the like, pushing and pulling on the subject, and/or the like. Such techniques may require a large number of medical personnel, may result in injury or incorrect positioning of the subject, may result in injury to the medical personnel, and/or the like.

SUMMARY

In an aspect, a method of rotating a horizontally laying subject in a first orientation on a support surface includes arranging at least one lifting aid to extend in a lateral direction underneath the subject such that a midline of the subject is located off center from a centerline of the lifting aid in a direction opposite a direction of rotation, the lifting aid including a first end extending laterally toward the direction of rotation and a second end extending laterally toward the direction opposite the direction of rotation, the first end having at least one first loop and the second end having at least one second loop. The method further includes connecting the at least one first loop and the at least one second loop to a sling bar coupled to an overhead lift and directing the overhead lift to raise the sling bar, where the subject rotates towards the direction of rotation as the overhead lift raises the sling bar due to the off center location of the subject. The method further includes repositioning the subject with respect to the support surface when the subject has rotated to a lateral recumbent position and directing the overhead lift to lower the sling bar, thereby causing the subject to continue rotating to a second orientation that is 180° from the first orientation. In some aspects, arranging the at least one lifting aid includes arranging a plurality of multi-use straps. In some aspects, arranging the at least one lifting aid includes arranging a lifting sheet. In some aspects, the first orientation is a prone position and the second orientation is a supine position. In some aspects, the first orientation is a supine position and the second orientation is a prone position. In some aspects, the method further includes raising a support surface upon which the subject is laying to a working height and lowering one or more side rails prior to arranging the lifting aid. In some aspects, the method further includes moving one or more of tubing, leads, lines, and braces prior to arranging the lifting aid. In some aspects, connecting the at least one first loop and the at least one second loop to the sling bar includes connecting the at least one first loop to a first retention component of the sling bar and connecting the at least one second loop to a second retention component of the sling bar. In some aspects, the at least one first loop includes a plurality of first loops and the at least one second loop includes a plurality of second loops. In some aspects, the method further includes connecting one loop of the plurality of first loops and one loop of the plurality of second loops to a second sling bar coupled to a second overhead lift. In some aspects, arranging the at least one lifting aid includes arranging an upper edge of the at least one lifting aid such that the upper edge is longitudinally positioned at a location between a shoulder and an armpit of the subject. In some aspects, arranging the at least one lifting aid includes arranging the at least one first loop and the at least one second loop such that at least one first loop and the at least one second loop are longitudinally aligned with a location between a shoulder and an armpit of the subject. In some aspects, arranging the at least one lifting aid includes arranging an upper edge of the at least one lifting aid such that the upper edge is longitudinally positioned at a location that is from 1 cm to 10 cm in an inferior direction from a top of a shoulder of the subject. In some aspects, arranging the at least one lifting aid includes arranging the at least one first loop and the at least one second loop such that at least one first loop and the at least one second loop are longitudinally aligned with a location that is from 1 cm to 15 cm in an inferior direction from a top of a shoulder of the subject. In some aspects, arranging the at least one lifting aid includes arranging a lower edge of the at least one lifting aid such that the lower edge is longitudinally positioned at a location between a waist and a knee of the subject. In some aspects, arranging the at least one lifting aid includes arranging a lower edge of the at least one lifting aid such that the lower edge is longitudinally positioned at a location that corresponds to a greater trochanter of the subject. In some aspects, the method further includes lowering sling bar to a connection height prior to connecting the at least one first loop. In some aspects, the method further includes positioning one or more of the subject's arms and legs prior to directing the overhead lift to raise the sling bar. In some aspects, the method further includes positioning one or more of a wedge and a fluidizer with respect to the subject prior to directing the overhead lift to raise the sling bar. In some aspects, the method further includes positioning one or more of a wedge and a fluidizer with respect to the subject prior to directing the overhead lift to lower the sling bar. In some aspects, the method further includes adjusting one or more of tubing, leads, lines, and braces. In some aspects, repositioning the subject includes sliding the subject laterally across the support surface in a direction that is away from the direction of rotation.

In another aspect, method of preparing a horizontally laying subject for rotation includes determining that the subject will be rotated in a first direction, arranging a plurality of multi-use straps to extend in a lateral direction underneath the subject such that a midline of the subject is located off center from a centerline of the plurality of multi-use straps in a second direction opposite the first direction, connecting a first loop located at a first end of each one of the plurality of multi-use straps to one or more sling bars coupled to one or more overhead lifts, and connecting a second loop located at a second end of each one of the plurality of multi-use straps to the one or more sling bars, the second end opposite the first end. The first end of each one of the plurality of multi-use straps extends in the first direction and the second end of the plurality of multi-use straps extends in the second direction. In some aspects, the horizontally laying subject is laying in a prone position. In some aspects, the horizontally laying subject is laying in a supine position. In some aspects, the method further includes raising a support surface upon which the subject is laying to a working height and lowering one or more side rails prior to arranging. In some aspects, the method further includes moving one or more of tubing, leads, lines, and braces prior to arranging. In some aspects, connecting the first loop of each one of the plurality of multi-use straps to the one or more sling bars and connecting the second loop of each one of the plurality of multi-use straps to the one or more sling bars includes connecting the first loop of each one of the plurality of multi-use straps to a first retention component of the one or more sling bars and connecting the second loop of each one of the plurality of multi-use straps to a second retention component of the one or more sling bars. In some aspects, the one or more sling bars are a first sling bar and a second sling bar, the first sling bar coupled to a first overhead lift of the one or more overhead lifts and the second sling bar coupled to a second overhead lift of the one or more overhead lifts. In some aspects, arranging the plurality of multi-use straps includes arranging a multi-use strap of the plurality of multi-use straps such that an upper edge of the multi-use strap is longitudinally positioned at a location between a shoulder and an armpit of the subject. In some aspects, arranging the plurality of multi-use straps includes arranging a multi-use strap of the plurality of multi-use straps such that an upper edge of the multi-use strap is longitudinally positioned at a location that is from 1 cm to 15 cm in an inferior direction from a top of a shoulder of the subject. In some aspects, arranging the plurality of multi-use straps includes arranging a multi-use strap such that an upper edge of the multi-use strap is longitudinally positioned at a location between a waist and a knee of the subject. In some aspects, arranging the plurality of multi-use straps includes arranging a multi-use strap such that an upper edge of the multi-use strap is longitudinally positioned at a location that corresponds to a greater trochanter of the subject. In some aspects, the method further includes lowering the one or more sling bars to a connection height. In some aspects, the one or more sling bars is a single sling bar having a length and the method further includes aligning the single sling bar such that the length of the single sling bar is substantially parallel to a sagittal plane of the subject.

In yet another aspect, a method of preparing a horizontally laying subject for rotation includes determining that the subject will be rotated in a first direction, arranging a lifting sheet to extend in a lateral direction underneath the subject such that a midline of the subject is located off center from a centerline of the lifting sheet in a second direction opposite the first direction, the lifting sheet comprising a first side edge extending laterally toward the first direction and a second side edge extending laterally toward the second direction, the first side edge comprising a plurality of first loops and the second side edge comprising a plurality of second loops, connecting at least two of the plurality of first loops to one or more sling bars coupled to one or more overhead lifts, and connecting at least two of the plurality of second loops to the one or more sling bars. In some aspects, the horizontally laying subject is laying in a prone position. In some aspects, the horizontally laying subject is laying in a supine position. In some aspects, the method further includes raising a support surface upon which the subject is laying to a working height and lowering one or more side rails prior to arranging. In some aspects, the method further includes moving one or more of tubing, leads, lines, and braces prior to arranging. In some aspects, connecting at least two of the plurality of first loops to the one or more sling bars and connecting at least two of the plurality of second loops to the one or more sling bars includes connecting at least two of the plurality of first loops to a first retention component of the one or more sling bars and connecting at least two of the plurality of second loops to a second retention component of the one or more sling bars. In some aspects, the one or more sling bars are a first sling bar and a second sling bar, the first sling bar coupled to a first overhead lift of the one or more overhead lifts and the second sling bar coupled to a second overhead lift of the one or more overhead lifts. In some aspects, arranging the lifting sheet includes arranging the lifting sheet such that a first loop of the plurality of first loops and a second loop of the plurality of second loops are positioned longitudinally at a location between a shoulder and an armpit of the subject. In some aspects, arranging the lifting sheet includes arranging the lifting sheet such that a first loop of the plurality of first loops and a second loop of the plurality of second loops are longitudinally positioned at a location that is from 1 cm to 15 cm in an inferior direction from a top of a shoulder of the subject. In some aspects, arranging the lifting sheet includes arranging the lifting sheet such that a first loop of the plurality of first loops and a second loop of the plurality of second loops are positioned longitudinally at a location between a waist and a knee of the subject. In some aspects, arranging the lifting sheet includes arranging the lifting sheet such that a first loop of the plurality of first loops and a second loop of the plurality of second loops are longitudinally positioned at a location that corresponds to a greater trochanter of the subject. In some aspects, the method further includes lowering the one or more sling bars to a connection height. In some aspects, the one or more sling bars is a single sling bar having a length and the method further includes aligning the single sling bar such that the length of the single sling bar is substantially parallel to a sagittal plane of the subject.

In yet another aspect, a method of rotating a subject laying horizontally in a first orientation on a support surface includes directing an overhead lift to raise a sling bar supporting a plurality of first loops and a plurality of second loops of a plurality of multi-use straps positioned under the subject on the support surface, the plurality of multi-use straps extending laterally such that a midline of the subject is located off center from a centerline of the plurality of multi-use straps in a direction that is opposite a direction of rotation, each of the plurality of multi-use straps having a first end extending in the direction of rotation and a second end extending in the direction that is opposite the direction of rotation, the first end of each of the plurality of multi-use straps comprising a first loop of the plurality of first loops and the second end of the plurality of multi-use straps comprising a second loop of the plurality of second loops. The subject rotates towards the direction of rotation as the overhead lift raises the sling bar due to the off center location of the subject. The method further includes repositioning the subject with respect to the support surface when the subject has rotated to a lateral recumbent position, and directing the overhead lift to lower the sling bar, thereby causing the subject to continue rotating to a second orientation that is 180° from the first orientation.

In yet another aspect, a method of rotating a subject laying horizontally in a first orientation on a support surface includes directing an overhead lift to raise a sling bar supporting a plurality of first loops and a plurality of second loops of a lifting sheet positioned under the subject on the support surface, the lifting sheet extending laterally such that a midline of the subject is located off center from a centerline of the lifting sheet in a direction that is opposite a direction of rotation, the lifting sheet having a first side edge extending laterally toward the direction of rotation and a second side edge extending laterally toward the direction that is opposite the direction of rotation, the first side edge comprising the plurality of first loops and the second side edge comprising the plurality of second loops. The subject rotates towards the direction of rotation as the overhead lift raises the sling bar due to the off center location of the subject. The method further includes repositioning the subject with respect to the support surface when the subject has rotated to a lateral recumbent position, and directing the overhead lift to lower the sling bar, thereby causing the subject to continue rotating to a second orientation that is 180° from the first orientation.

In yet another aspect, a method of rotating a horizontally laying subject in a first orientation on a support surface includes arranging at least one lifting aid to extend in a lateral direction underneath the subject such that a midline of the subject is aligned with a centerline of the lifting aid. The lifting aid includes a first end extending laterally toward the direction of rotation and a second end extending laterally toward the direction opposite the direction of rotation. The first end includes at least one first loop and the second end includes at least one second loop. The method further includes connecting the at least one first loop and the at least one second loop to a sling bar coupled to an overhead lift. The method further includes directing the overhead lift to raise the sling bar. The subject rotates towards the direction of rotation as the overhead lift raises the sling bar due to the off center location of the subject. The method further includes repositioning the subject with respect to the support surface when the subject has rotated to a lateral recumbent position. The method further includes directing the overhead lift to lower the sling bar, thereby causing the subject to continue rotating to a second orientation that is 180° from the first orientation.

Additional features and advantages of the aspects described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
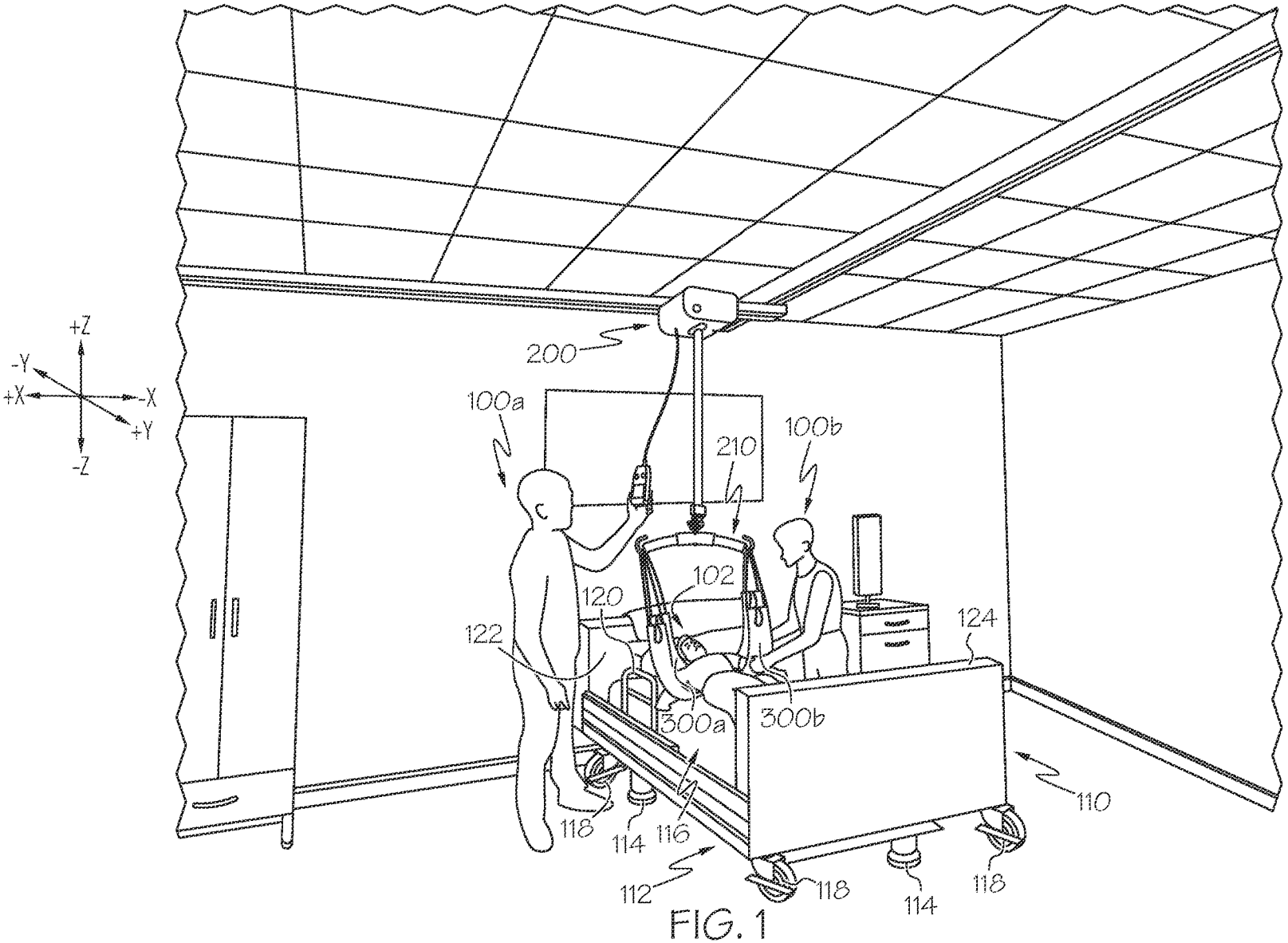
FIG. 1 schematically depicts an illustrative scene of a plurality of individuals performing a rotating method on a subject using an overhead lift according to one or more embodiments shown and described herein.
Figure 2A:
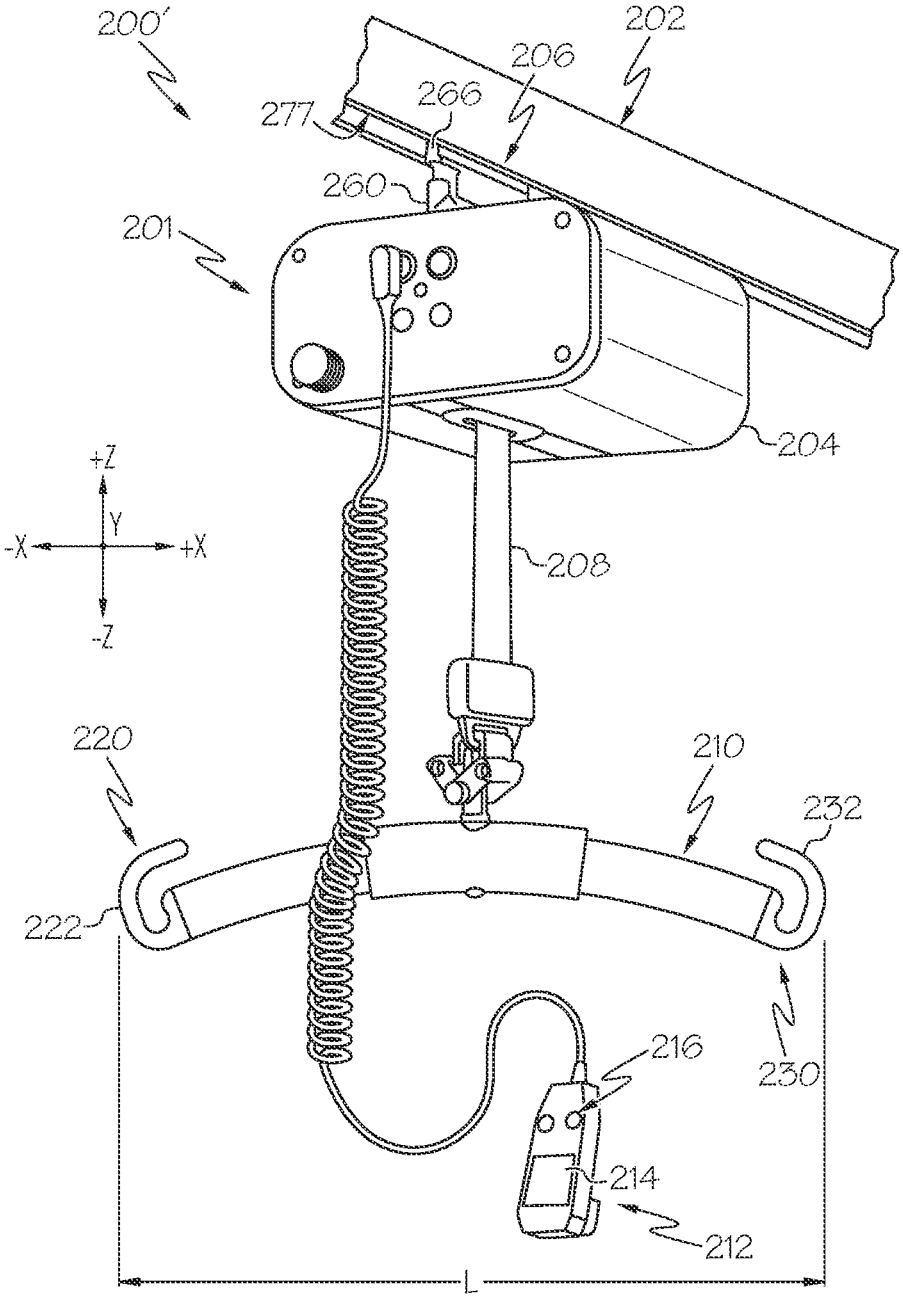
FIG. 2A schematically depicts an illustrative rail-mounted lift used for rotating a subject according to one or more embodiments shown and described herein.
Figure 2B:
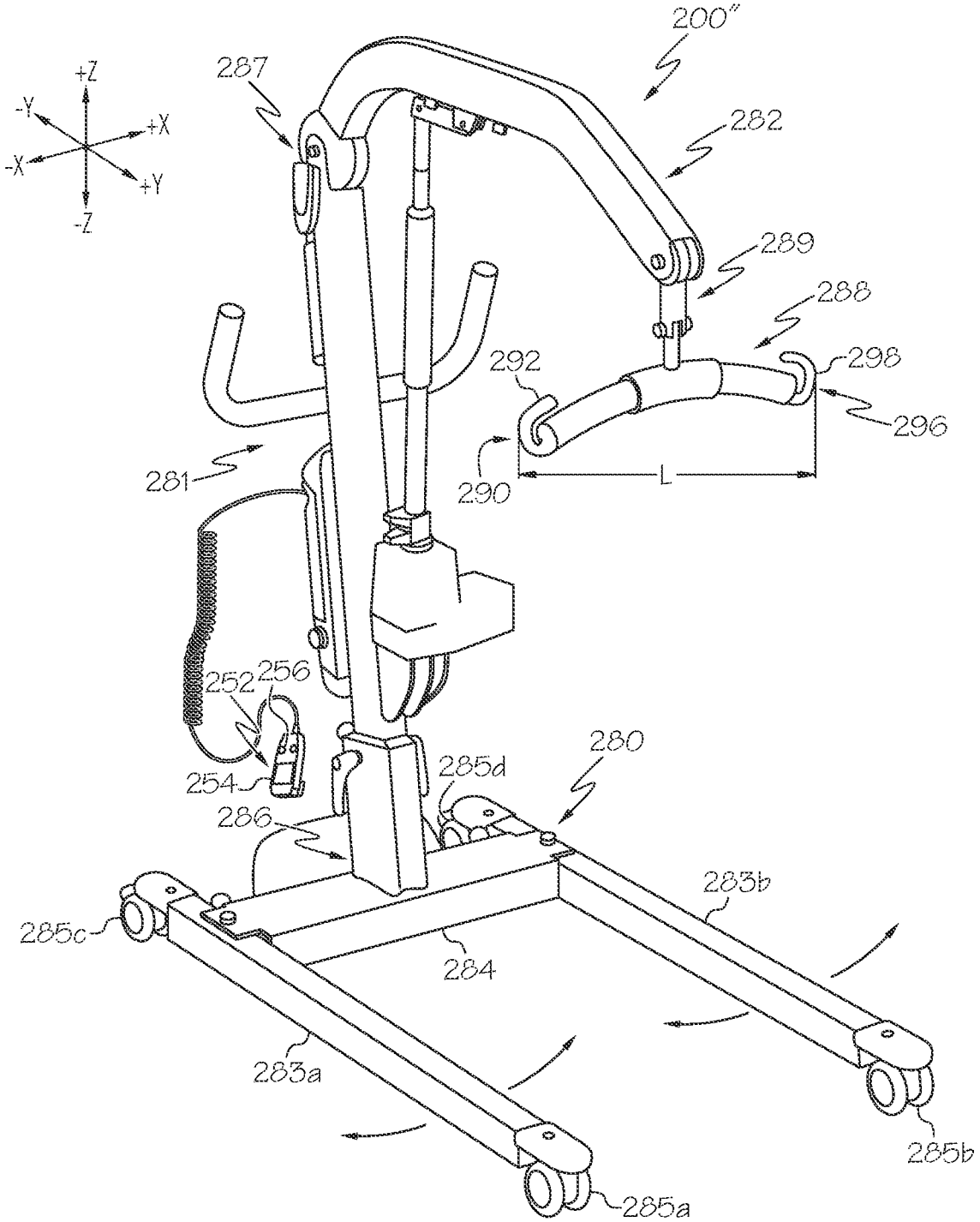
FIG. 2B schematically depicts an illustrative mobile lift used for rotating a subject according to one or more embodiments described herein.
Figure 3A:
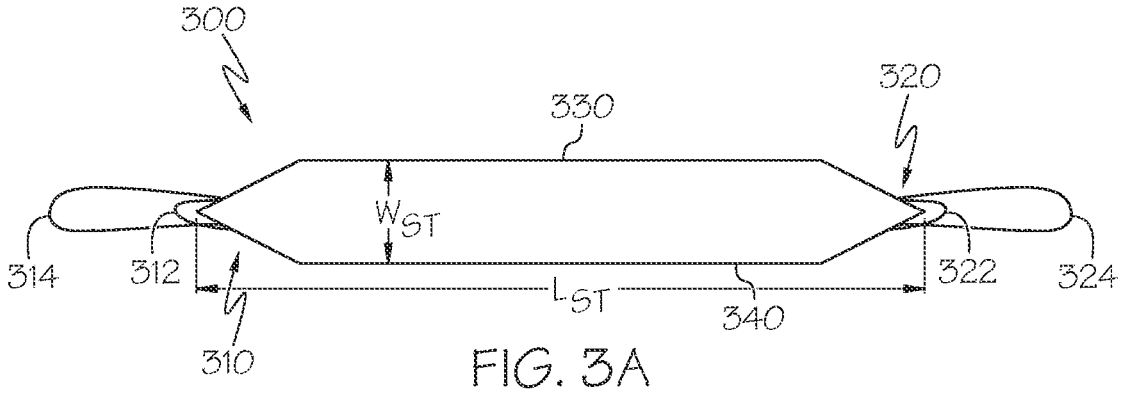
FIG. 3A schematically depicts an illustrative multi-use strap used for rotating a subject according to one or more embodiments shown and described herein.
Figure 3B:
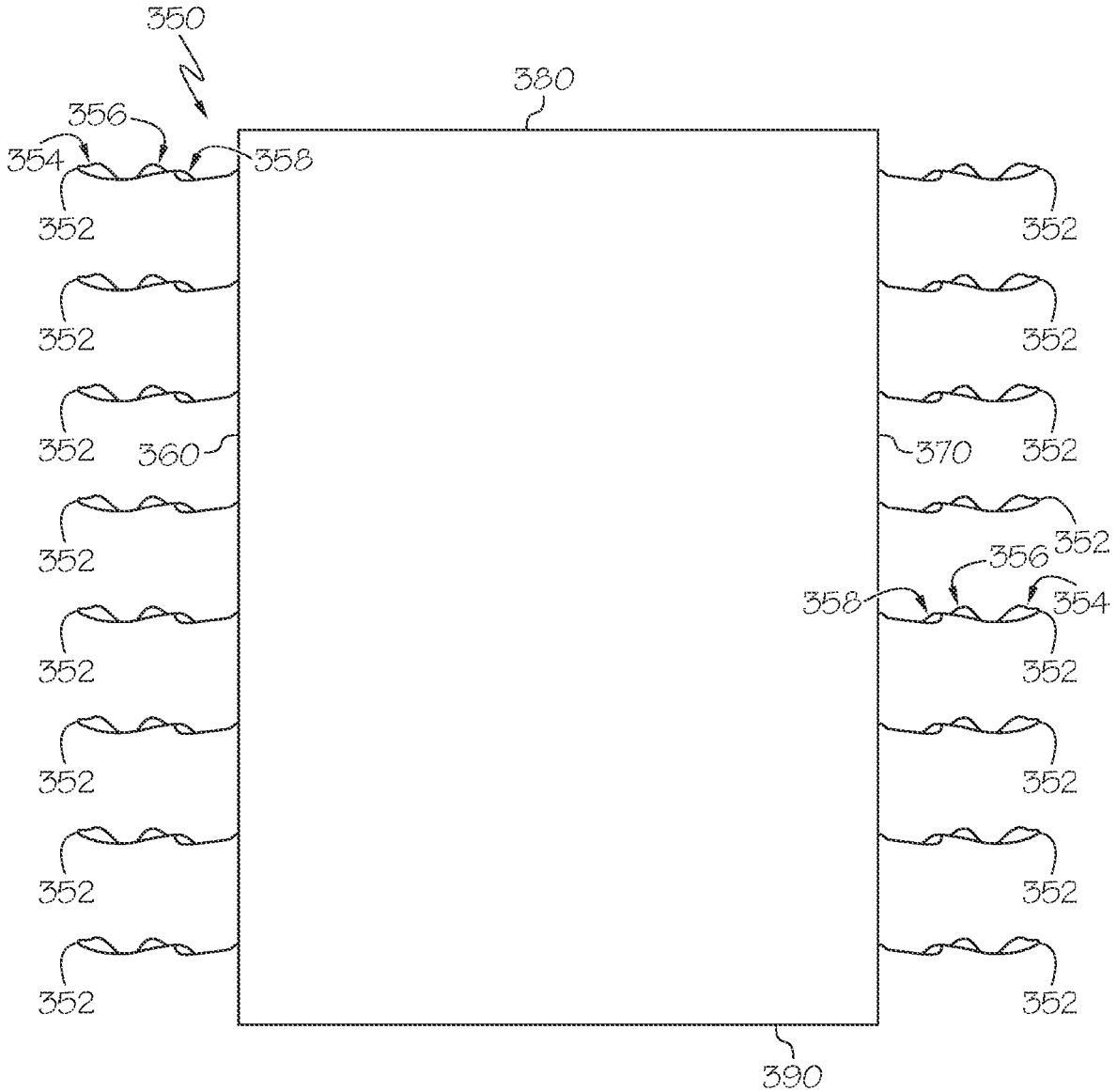
FIG. 3B schematically depicts an illustrative lifting sheet used for rotating a subject according to one or more embodiments shown and described herein.
Figure 4:
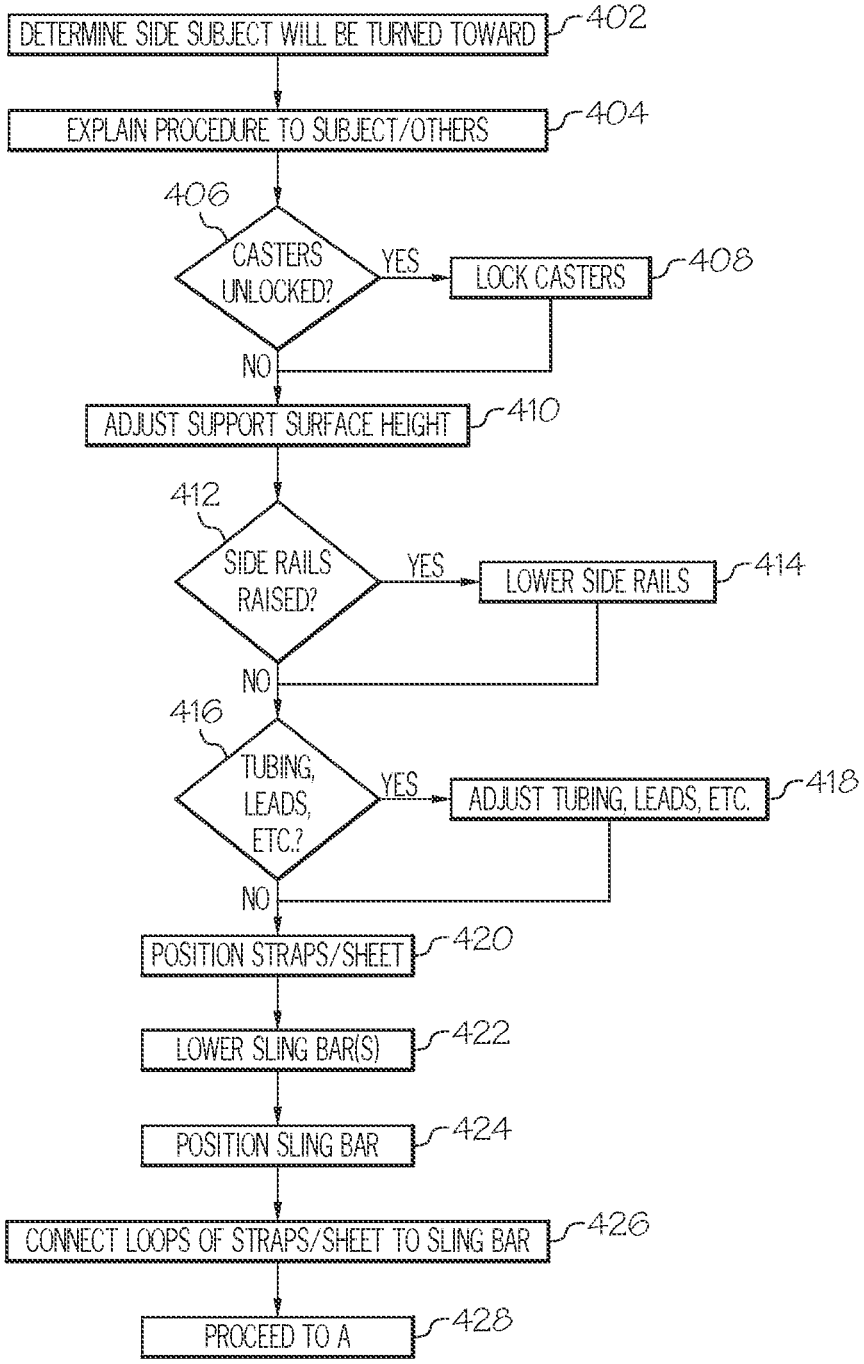
FIG. 4 depicts a flow diagram of an illustrative method of preparing an overhead lift and a lifting sheet or a plurality of multi-use straps for rotating a subject according to one or more embodiments described herein.

Reference will now be made in detail to methods of rotating a subject from a prone position to a supine position and/or from a supine position to a prone position using one or more overhead lifts, examples of which are illustrated in the accompanying drawings. Whenever possible, the same reference numerals will be used throughout the drawings to refer to the same or like parts. One embodiment of a lift system used for carrying out the various methods described herein is depicted in FIG. 1, in which the lift system includes at least one overhead lift and either a plurality of multi-use straps or a lifting sheet. Various overhead lifts for use in the lift system are depicted in FIGS. 2A-2B. FIG. 3A depicts an illustrative multi-use strap and FIG. 3B depicts an illustrative lifting sheet. FIG. 4 depict various steps in a method of arranging a subject with respect to the multi-use straps or lifting sheet and connecting the multi-use straps or lifting sheet to one or more overhead lifts, which is schematically depicted in FIGS. 5A-5D, 6A-6B, and 7A-7C. FIG. 8 depicts various steps in a method of rotating a subject using the overhead lift system described herein, which is schematically depicted in FIGS. 9A-9F.

As will be evident from the present disclosure, the methods described herein allow for medical personnel to rotate a horizontally laying subject from a prone position to a supine position (e.g., a 180° rotation) and/or from a supine position to a prone position (e.g., a 180° rotation) with minimum effort relative to previous manual methods of rotating a subject (e.g., personnel pushing and/or pulling on a subject, personnel utilizing bedsheets to move subjects, and/or various other actions that generally require physically demanding actions from medical personnel). Furthermore, the methods described herein can generally be completed with fewer personnel relative to other manual methods of rotating a subject. That is, the methods described herein can be completed with as few as one or two individuals rotating the subject, whereas other manual methods generally require greater than three individuals, particularly in instances where subjects are large in size (e.g., bariatric subjects), are connected to a plurality of leads, tubing, lines, braces, and/or the like, have a physical deformity that hinders rotational movement, and/or the like. The methods described herein also use equipment that is more readily available, more easily transported, and less expensive than other devices, systems, and methods that can be used to rotate subjects, such as specialized rotating beds, complex pulley systems that require particular positioning and arrangement over a surface that the subject is laying on, complex pulley systems having drive components for rotating subjects, complex systems that must be bolted to or otherwise connected over a bed or other surface upon which the subject is laying, systems that utilize webbing that may be difficult to arrange with respect to a subject and/or is subject to damage, devices that grip a bedsheet and have a potential to lose such a grip while a rotation process is occurring, and/or the like. The methods described herein are also easier for personnel to complete, and do not require medical personnel to reconfigure strap loops in the middle of a turning process in order to complete a turn. Other advantages of the methods described herein will be apparent upon a reading of the present disclosure.

FIG. 1 depicts an illustrative scene of a plurality of individuals (e.g., a first individual 100*a* and a second individual 100*b*) performing a method of lifting a subject 102 laying horizontally in a supine position on a person support apparatus 110. As depicted in FIG. 1, the first individual 100*a* is controlling an overhead lift 200 that includes a sling bar 210 coupled to a plurality of multi-use straps 300 that are positioned underneath the subject 102 (e.g., positioned between the subject 102 and the person support apparatus 110). The second individual 100*b* is facilitating additional movement of the subject 102 and is ensuring that leads, tubing, lines, braces, and/or the like are correctly positioned, as described in greater detail herein. In some embodiments, an additional individual may also be present, such as a respiratory therapist or the like that maintains a positioning of the head of the subject 102 and ensures appropriate positioning of tubing or the like. As a result of the processes described herein, rotation of the horizontally laying subject 102 is completed to move the subject 180° from supine to prone (or alternatively from prone to supine).

The person support apparatus 110 is generally a support surface for supporting the subject 102 thereon. For example, the person support apparatus 110 may be a hospital bed, a stretcher, a surgical table, a gurney, a chair, or similar support apparatuses commonly found in hospitals, nursing homes, rehabilitation centers, or the like. The person support apparatus 110 generally includes a base frame 112, a plurality of lift members 114 coupled to the base frame 112, and a support surface 116 supported by the base frame 112. The base frame 112 also includes a plurality of wheels or casters 118 that are movable along a ground surface and can be locked in position to prevent or hinder further movement.

The lift members 114 are coupled to various linear actuators, such as jack motors and the like (not shown) and related mechanical and electrical components that facilitate raising, lowering, and tilting the support surface 116 with respect to the base frame 112. Tilting of the support surface 116 relative to the base frame 112 may also be referred to as orienting the support surface 116 in a Trendelenburg orientation or a reverse Trendelenburg orientation. In a Trendelenburg orientation, the head end of the support surface 116 is lower than the foot end of the support surface 116 while in a reverse Trendelenburg orientation, the foot end of the support surface 116 is lower that the head end of the support surface 116.

The person support apparatus 110 may further include side rails 120, a headboard 122, and a footboard 124. The side rails 120, the headboard 122, and the footboard 124 are supported by an upper frame of the person support apparatus 110 that also supports the support surface 116 and is connected to the base frame 112. The side rails 120, the headboard 122, and the footboard 124 are affixed to the upper frame such that the side rails 120, the headboard 122, and the footboard 124 generally define the perimeter edge of the upper frame and the support surface 116 thereon. In some embodiments, the side rails 120 may include a plurality of sections. For example, in some embodiments, the side rails 120 may each include a head side rail portion, located adjacent to the head end of the support surface 116 and an intermediate side rail portion positioned between the head side rail portion and the foot end of the support surface 116. At least one of the side rails 120 may include one or more user interfaces for control and/or display of the features of the person support apparatus 110. Foot pedal controls (not shown) may be coupled to the base frame 112 and communicatively coupled to one or more actuators, motors, or the like for raising and lowering the height of the support surface 116.

The overhead lift 200 is generally a lifting device that is positioned above the subject 102 and the person support apparatus 110 and is movable upwards or downwards (e.g., in the +z/−z direction of the coordinate axes of FIG. 1), as described in greater detail herein. The overhead lift 200, as depicted in FIG. 1, is depicted in greater detail in FIG. 2A as a rail-mounted lift 200'. However, the present disclosure is not limited to the rail-mounted lift 200' depicted in FIG. 2A. That is, other overhead lifts may be used to perform the methods described herein. One illustrative example of another overhead lift 200 is a mobile lift 200" depicted in FIG. 2B. The mobile lift 200" is generally a free standing device that is movable along a floor surface of a hospital or medical facility. The mobile lift 200" contains one or more components that can be used to lift a person, as described in greater detail herein. While only a single rail-mounted lift 200' (FIG. 2A) and a single mobile lift 200" (FIG. 2B) are depicted, it should be understood that a plurality of rail-mounted lifts 200' (FIG. 2A) or a plurality of mobile lifts 200" (FIG. 2B) may be used, as described in greater detail herein. Illustrative examples of commercially available lifts that may be used according to the methods described herein include, but are not limited to, a Golvo® lift, a Viking® series lift, a Liko® lift, a LikoGuard™ overhead lift, a Likorall™ overhead lift, a Multirall™ overhead lift, and an UltraTwin™ overhead lift, all available from Hillrom (Batesville, Ind.).

In some embodiments, the mobile lift 200" (FIG. 2B) may be used in lieu of the rail-mounted lift 200' (FIG. 2A). That is, either the mobile lift 200" (FIG. 2B) or the rail-mounted lift 200' (FIG. 2A) are used to perform the various methods described herein, but not both. For purposes of brevity, the present disclosure outside of FIG. 2B primarily relates to the rail-mounted lift 200' depicted in FIG. 2A. However, it should be understood that the functionality of the rail-mounted lift 200' described herein also applies to the mobile lift 200" of FIG. 2B.

Using the components shown in FIGS. 2A and 2B, the rail-mounted lift 200' and/or the mobile lift 200" can be operated via controls within a user interface. For example, as shown in FIG. 2A, the rail-mounted lift 200' includes a hand control unit 212 that provides user interface functionality. Similarly, as shown in FIG. 2B, the mobile lift 200" includes a hand control unit 252 that provides user interface functionality. Referring to FIGS. 2A-2B, the hand control unit 212 and the hand control unit 252 provides a user with an ability to complete various tasks including, but not limited to, moving components up/down, moving components laterally, activating the rail-mounted lift 200' and/or the mobile lift 200", pairing two rail-mounted lifts 200' together or pairing two mobile lifts 200" together, returning the rail-mounted lift 200' and/or the mobile lift 200" to a "home" position/location, receiving information from the rail-mounted lift 200' and/or the mobile lift 200" (e.g., battery status, weight of load supported by lift unit, movement history, associated subjects, etc.), performing an emergency stop of the rail-mounted lift 200' and/or the mobile lift 200", resetting the rail-mounted lift 200' and/or the mobile lift 200", and/or the like.

Referring now to FIG. 2A, the rail-mounted lift 200' generally includes an assembly 201 coupled to a rail 202. More specifically, the assembly 201 includes a lift unit 204 that is slidably coupled to a rail 202 via a carriage 206. The lift unit 204 may be used to support and/or lift a subject with a lifting strap 208 which is coupled to a motor (not shown) contained within the lift unit 204. The motor facilitates extending or retracting the lifting strap 208 from the lift unit 204, thereby raising and lowering a subject attached to the lifting strap 208.

In the embodiment of the rail-mounted lift 200' depicted in FIG. 2A, a subject may be supported by the lifting strap 208 via a sling bar 210 attached to the lifting strap 208. More specifically, the sling bar 210 may be attached to the plurality of lifting straps and/or the lifting sheet in which the subject is positioned (as described in greater detail hereinbelow), thereby facilitating the lifting operation. The sling bar 210 has a length L extending between a first end 220 of the sling bar 210 and a second end 230 of the sling bar 210. The first end 220 of the sling bar 210 includes a first retention component 222 and the second end 230 of the sling bar 210 includes a second retention component 232. The first retention component 222 and the second retention component 232 are generally shaped, sized, and configured to retain loops of the lifting straps or the lifting sheet, as described in greater detail herein. For example, the first retention component 222 and the second retention component 232 may be hook shaped, as depicted in FIG. 2A. The length L of the sling bar 210 is not limited by the present disclosure, and may generally be any length. In some embodiments, the length L of the sling bar 210 may generally correspond to a width of the person support apparatus 110 (FIG. 1). Still referring to FIG. 2A, in other embodiments, the length L of the sling bar 210 may be sufficient to extend a distance that is the same or longer than a lateral width of a subject supported by the sling bar 210 (e.g., a length taken along a transverse plane at a widest location on the subject).

Still referring to FIG. 2A, various components of the assembly 201, such as the lift unit 204 and/or components thereof, may be operated with the hand control unit 212 that is communicatively coupled to the lift unit 204. In the embodiment shown in FIG. 2A, the hand control unit 212 is directly wired to the lift unit 204. However, the hand control unit 212 may be wireless coupled to the lift unit 204 (and/or one or more components thereof) in other embodiments. In some embodiments, the lift unit 204 may be controllable by a remote device wirelessly coupled to the lift unit 204, such as a wall screen, a mobile device, and/or the like.

In some embodiments, the hand control unit 212 may include a display 214 and/or one or more user interface controls 216. The display 214 is generally any liquid crystal display (LCD), light emitting diode (LED) display, electronic ink (e-ink) display, or the like that can display information to a user. In some embodiments, the display 214 may be configured as an interactive display that can receive user inputs (e.g., a touch screen display or the like). The one or more user interface controls 216 may be hardware components that receive inputs from a user and transmit signals corresponding to the inputs, such as a keyboard, a mouse, a joystick, a touch screen, a remote control, a pointing device, a video input device, an audio input device, a haptic feedback device, and/or the like. In some embodiments, the display 214 and one or more of the user interface controls 216 may be combined into a single device, such as a touchscreen display or the like. The display 214 and/or the one or more user interface controls 216 may be used, for example, to allow a user to operate the lift unit 204, such as, for example, to cause the lifting strap 208 to pay out, thereby lowering the sling bar 210 (e.g., move in the −z direction of the coordinate axes of FIG. 2A), to cause the lifting strap 208 to take up, thereby raising the sling bar 210 (e.g., move in the +z direction of the coordinate axes of FIG. 2A).

The lift unit 204 is mechanically coupled to the carriage 206, which facilitates slidably positioning the lift unit 204 along the rail 202. While not depicted in FIG. 2A, the lift unit 204 includes a connection rail which is mounted to a top surface of the lift unit 204. The connection rail facilitates connecting and securing the lift unit 204 to the carriage 206. In embodiments, the carriage 206 generally includes a carriage body 260 having an extension 266 to which a plurality of support wheels (not shown) are rotatably attached for supporting the carriage 206 in the rail 202. The support wheels facilitate positioning the carriage 206 and lift unit 204 along the length of the rail 202. The support wheels are positioned on axles which extend transversely through the carriage body 260.

Still referring to FIG. 2A, the carriage 206 is slidably disposed in the rail 202 for relative movement to the rail 202. Accordingly, it should be understood that, when the lift unit 204 is mechanically coupled to the carriage 206, the lift unit 204 may be traversed along the rail 202 with the carriage 206. The rail 202 is generally formed from a metallic material, such as aluminum, an aluminum alloy, or a similar metallic material. The rail 202 generally includes various walls that form a carriage support channel 277 in which the carriage 206 is slidably disposed. More specifically, the lift unit 204 with attached carriage 206 is suspended from the rail 202 by positioning the extension 266 of the carriage body 260 in the rail 202 such that the support wheels are slidably engaged with support flanges within the carriage support channel 277.

Referring again to FIG. 2B, the mobile lift 200" may also include a base 280, a lift mast 281 and a lift arm 282. The base 280 may include one or more base legs (e.g., base legs 283*a*, 283*b*) which are attached to a cross support 284. The base legs 283*a*, 283*b* may include one or more casters (e.g., a pair of front casters 285*a*, 285*b* and/or a pair of rear casters 285*c*, 285*d*). The rear casters 285*c*, 285*d* may comprise caster brakes. In some embodiments, the casters may be powered casters that are coupled to a motor, actuator, or the like that drives movement of the casters, and thus the mobile lift 200" throughout a space. Control of the motor, actuator, or the like may be completed using the hand control unit 252, as described in greater detail herein.

In one embodiment, the base 280 may further include a mast support 286 disposed on the cross support 184. In one embodiment, the mast support 286 may be a rectangular receptacle configured to receive the lift mast 281 of the mobile lift 200". For example, a first end of the lift mast 281 may be adjustably received in the mast support 286 and secured with a pin, threaded fastener, or a similar fastener. The pin or threaded fastener may extend through the mast support 286 and into a corresponding adjustment hole(s) (not shown) on the lift mast 281. In another example, the mast support 286 may include an actuator therein that couples to the lift mast and allows for vertical movement of the lift mast 281 (e.g., up and down movement of the lift mast 281 in the +/−z directions of the coordinate axes of FIG. 2B). Accordingly, it will be understood that the position of the lift mast 281 may be adjusted vertically with respect to the base 280 by repositioning the lift mast 281 in the mast support 286 using the actuator. Control of the actuator may be completed using the hand control unit 252, as described in greater detail herein.

In some embodiments, the lift arm 282 is pivotally coupled to the lift mast 281 at a lift arm pivot 287 at a second end of the lift mast 281 such that the lift arm 282 may be pivoted (e.g., raised, lowered, moved from side to side) with respect to the base 280. In some embodiments, the lift arm 282 may be coupled to one or more actuators at the lift arm pivot 287 such that the actuators facilitate the pivot movement of the lift arm 282. Control of the one or more actuators may be completed using the hand control unit 252, as described in greater detail herein.

The lift arm 282 may include at least one sling bar 288 coupled to the lift arm 282 with a coupling member 289 such that the sling bar 288 is raised or lowered with the lift arm 282. In the embodiment shown in FIG. 2B, the coupling member 289 is pivotally attached to the lift arm 282 at an end of the lift arm 282 opposite the lift arm pivot 287. In one embodiment, the coupling member 289 is pivotally attached to the lift arm 282 at attachment pivot such that the sling bar 288 may be pivoted with respect to the lift arm 282. However, it should be understood that, in other embodiments, the coupling member 289 may be fixedly attached to the lift arm 282 or that the sling bar 288 may be directly coupled to the lift arm 282 without the use of a coupling member 289.

A subject may be supported by the lift arm 282 via the sling bar 288 attached to the lift arm 282. More specifically, the sling bar 288 may be attached to the plurality of multi-use straps and/or the lifting sheet in which the subject is positioned (as described in greater detail hereinbelow), thereby facilitating the lifting operation. The sling bar 288 has a length L extending between a first end 290 of the sling bar 288 and a second end 296 of the sling bar 288. The first end 290 of the sling bar 288 includes a first retention component 292 and the second end 296 of the sling bar 288 includes a second retention component 298. The first retention component 292 and the second retention component 298 are generally shaped, sized, and configured to retain loops of the multi-use straps or the lifting sheet, as described in greater detail herein. For example, the first retention component 292 and the second retention component 298 may be hook shaped, as depicted in FIG. 2B. The length L of the sling bar 288 is not limited by the present disclosure, and may generally be any length. In some embodiments, the length L of the sling bar 288 may generally correspond to a width of the person support apparatus 110 (FIG. 1). Still referring to FIG. 2B, in other embodiments, the length L of the sling bar 288 may be sufficient to extend a distance that is the same or longer than a lateral width of a subject supported by the sling bar 288 (e.g., a length taken along a transverse plane at a widest location on the subject).

In the embodiments described herein, the mobile lift 200" is a mechanized lifting device. Accordingly, raising and lowering the lift arm 282 with respect to the base 280 may be achieved using an actuator such as a lift actuator or the like. The lift actuator may be a linear actuator that includes a motor mechanically coupled to an actuator arm. More specifically, the motor may include a rotating armature and the actuator arm may include one or more threaded rods coupled to the armature such that, when the armature is rotated, the threaded rods are extended or retracted relative to one another and the actuator arm is extended or retracted. In some embodiments, the lift actuator may further include a support tube disposed over the actuator arm. The support tube provides lateral support to the actuator arm as the actuator arm is extended. The lift actuator (as well as any other actuator within the mobile lift 200") is coupled to an electronic control unit that facilitates actuation and control of the lift actuator. While the embodiments described herein refer to the lift actuator as including a motor and an actuator arm, it will be understood that the lift actuator may have various other configurations and may include a hydraulic or pneumatic actuator comprising a mechanical pump or compressor, or a similar type of actuator. Further, in other embodiments, where the lifting device is a cable-based lift, the lift actuator may be a motor which pays out and/or takes-up cable, thereby raising and/or lowering an attached load. Accordingly, it will be understood that various other types of actuators may be used to facilitate raising and lowering the lift arm 282 and/or an attached load with respect to the base 280.

In some embodiments, the hand control unit 252 may include a display 214 and/or one or more user interface controls 256. The display 254 is generally any liquid crystal display (LCD), light emitting diode (LED) display, electronic ink (e-ink) display, or the like that can display information to a user. In some embodiments, the display 254 may be configured as an interactive display that can receive user inputs (e.g., a touch screen display or the like). The one or more user interface controls 256 may be hardware components that receive inputs from a user and transmit signals corresponding to the inputs, such as a keyboard, a mouse, a joystick, a touch screen, a remote control, a pointing device, a video input device, an audio input device, a haptic feedback device, and/or the like. In some embodiments, the display 254 and one or more of the user interface controls 256 may be combined into a single device, such as a touchscreen display or the like. The display 254 and/or the one or more user interface controls 256 may be used, for example, to allow a user to operate the mobile lift 200", such as, for example, to cause the lift arm 282 to lower, thereby lowering the sling bar 288 (e.g., move in the −z direction of the coordinate axes of FIG. 2B), to cause the lift arm 282 to raise, thereby raising the sling bar 288 (e.g., move in the +z direction of the coordinate axes of FIG. 2B).

It should be understood that the various embodiments described herein may particularly reference components of the rail-mounted lift 200' (e.g., sling bar 210). However, it should be understood that the mobile lift 200" and the components thereof (e.g., sling bar 288) may also be used without departing from the scope of the present disclosure.

FIG. 3A depicts an illustrative multi-use strap 300 that may be used for the purposes of rotating a subject according to the methods described herein. As shown in FIG. 3A, the multi-use strap 300 is generally a flat strip of material that is positionable under a subject (e.g., subject 102 depicted in FIG. 1). An illustrative example of the multi-use strap 300 is the Liko® MultiStrap™ lift aid available from Hillrom (Batesville, Ind.).

Still referring to FIG. 3A, the multi-use strap 300 includes a length $L_{ST}$ of material having a first end 310 separated from a second end 320. The length $L_{ST}$ of the multi-use strap 300 (e.g., the distance between the first end 310 and the second end 320) is not limited by the present disclosure and may generally be any length, particularly lengths that are suitable for the purposes of rotating a subject according to the methods described herein. For example, the length of the multi-use strap 300 may be less than about 75 cm, about 75 cm long, about 80 cm, about 85 cm, about 90 cm, about 95 cm, about 100 cm, about 105 cm, about 110 cm, about 115 cm, about 120 cm, greater than about 120 cm, or any value or range between any two of these values. In some embodiments, the length $L_{ST}$ of the multi-use strap 300 may be such that, when a subject is arranged with respect to the multi-use strap 300 as described herein, the multi-use strap 300 extends a distance laterally from the subject on both sides of the subject. That is, the length $L_{ST}$ of the multi-use strap 300 is longer than a lateral width of a subject at a location where the multi-use strap is positioned, as described in greater detail herein.

The multi-use strap 300 may further include an upper edge 330 and a lower edge 340 spaced apart by a width $W_{ST}$. The width $W_{ST}$ of the multi-use strap 300 is not limited by the present disclosure and may generally be any width, particularly widths that are sufficient to be placed underneath the subject 102 (FIG. 1) when the subject 102 is laying on the person support apparatus 110 (FIG. 1). Still referring to FIG. 3A, in some embodiments, the width $W_{ST}$ of the multi-use strap may be about 10 cm, about 15 cm, about 20 cm, about 25 cm, about 30 cm, about 35 cm, about 40 cm, about 45 cm, about 50 cm, or any value or range between any two of these values (including endpoints). In other embodiments, the width $W_{ST}$ of the multi-use strap 300 may be less than about 10 cm and/or greater than about 50 cm.

The general shape of the multi-use strap 300 is not limited by the present disclosure, and may generally be any shape. For example, as depicted in the embodiment of FIG. 3A, the multi-use strap 300 has a generally rectangular shape with tapered ends. That is, the multi-use strap 300 depicted in the embodiment of FIG. 3A is shaped such that the upper edge 330 and the lower edge 340 taper to a point at the first end 310 and the second end 320. Certain shapes that allow for ease of use in placing the multi-use strap 300 underneath a subject are also contemplated, such as strips of material that have a length that is greater than a width thereof.

The multi-use strap 300 may generally be constructed of any type of material, and such materials are not limited by the present disclosure. In some embodiments, the multi-use strap 300 may be constructed of a material that has strength properties allowing the multi-use strap 300 to support the weight of an average human subject. In some embodiments, the multi-use strap 300 may formed from a textile comprising natural fibers such as, for example, wool, flax, cotton, hemp, or the like. In some embodiments, the multi-use strap 300 may be formed from one or more synthetic fibers such as, for example, polyester, aramid, acrylic, nylon, spandex, olefin, carbon fiber, or the like.

The multi-use strap 300 generally includes a plurality of loops coupled to the length of material of the multi-use strap 300. For example, as depicted in the embodiment of FIG. 3A, the multi-use strap 300 includes a first short loop 312 and a first long loop 314 coupled at the first end 310 of the multi-use strap 300 and a second short loop 322 and a second long loop 324 coupled at the second end 320 of the multi-use strap 300. The loops each provide a connection point for the multi-use strap 300 to be connected to another object. For example, in the embodiments described herein, the loops are used as a connection point for connecting the multi-use strap 300 to the sling bar 210 (FIG. 1). The loops (e.g., the first short loop 312, the first long loop 314, the second short loop 322, and the second long loop 324) are coupled to the material of the multi-use strap 300 by any means of coupling, including, but not limited to, stitching, welding, use of fasteners (e.g., rivets or the like), use of adhesives, and/or the like. In some embodiments, the loops are integrated with the material of the multi-use strap 300. That is, the loops are formed as an extension of the material of the multi-use strap 300 such that the multi-use strap 300 (including the loops) are all formed from a single piece of material. As depicted in the embodiment of FIG. 3A, the first short loop 312 and the first long loop 314 are coupled to the tapered portion of the material of the multi-use strap 300 at the first end 310 thereof. Similarly, the second short loop 322 and the second long loop 324 are coupled to the tapered portion of the material of the multi-use strap 300 at the second end 320 thereof.

Each of the loops (e.g., the first short loop 312, the first long loop 314, the second short loop 322, and the second long loop 324) may have a length that is defined by a distance between a first connection point with the material of the multi-use strap 300 and a second connection point with the material of the multi-use strap 300. The first long loop 314 is generally longer in length than the first short loop 312 and the second long loop 324 is generally longer in length than the second short loop 322. The varying lengths of the loops provides an adjustable total usable length of the multi-use strap 300, depending on which loop is connected. For example, if the multi-use strap 300 is connected via the first short loop 312 and the second short loop 322, the total usable length of the multi-use strap 300 is less than a total usable length of the multi-use strap 300 when connected via the first long loop 314 and the second long loop 324. In some embodiments, the first short loop 312 and the second short loop 322 may have substantially similar lengths while the first long loop 314 and the second long loop 324 have substantially similar lengths. In other embodiments, the various loops may have different lengths. The lengths of the loops are otherwise not limited by the present disclosure, and may be any length. Illustrative lengths of the first short loop 312 and the second short loop 322 may be about 5 cm, about 10 cm, about 15 cm, about 20 cm, about 25 cm, about 30 cm, about 35 cm, about 40 cm, about 45 cm, about 50 cm, or any value or range between any two of these values (including endpoints). Illustrative lengths of the first long loop 314 and the second long loop 324 may be about 20 cm, about 25 cm, about 30 cm, about 35 cm, about 40 cm, about 45 cm, about 50 cm, about 55 cm, about 60 cm, about 65 cm, about 70 cm, about 75 cm, about 80 cm, about 85 cm, about 90 cm, about 95 cm, about 100 cm, or any value or range between any two of these values (including endpoints).

The loops (e.g., the first short loop 312, the first long loop 314, the second short loop 322, and the second long loop 324) may generally be constructed of any type of material, and such materials are not limited by the present disclosure. In some embodiments, the loops may be constructed of a material that has strength properties that allow the multi-use strap 300, together with the loops, to support the weight of an average human subject. In some embodiments, the loops may formed from a textile comprising natural fibers such as, for example, wool, flax, cotton, hemp, or the like. In some embodiments, the loops may be formed from one or more synthetic fibers such as, for example, polyester, aramid, acrylic, nylon, spandex, olefin, carbon fiber, or the like. In some embodiments, the loops may be formed of the same material as the material used for the remainder of the multi-use strap 300. In other embodiments, the loops may be formed from a different material than the material used for the remainder of the multi-use strap 300.

It should be understood that the loops depicted in FIG. 3A (e.g., the first short loop 312, the first long loop 314, the second short loop 322, and the second long loop 324) are merely one illustrative embodiment. In some embodiments, a single piece of loop material may extend from each of the first end 310 and the second end 320, the single piece of loop material including a plurality of loops formed thereon at particular distances along the length of the single piece of loop material. In some embodiments, the multi-use strap 300 may have a plurality of openings at each of the first end 310 and the second end 320 thereof, the plurality of openings reinforced (e.g., by use of a grommet or the like) and sized such that the openings can be placed over connection points on the sling bar 210 (FIG. 1). While the embodiment of FIG. 3A depicts the multi-use strap 300 having a total of four loops, the present disclosure is not limited to such. Other embodiments including fewer or greater than four loops are contemplated. For example, the multi-use strap 300 may have a single loop on each end thereof, each loop being substantially the same length. In addition, other types of loops and/or means of providing connection points on the sling bar 210 (FIG. 1) are also contemplated.

The multi-use strap 300 is one example of a lifting aid that may be used according to the methods herein. Another example of a lifting aid is a lifting sheet 350 depicted in FIG. 3B. Accordingly, both the multi-use strap 300 (FIG. 3A) and the lifting sheet 350 (FIG. 3B) may alternatively be referred to herein as a "lifting aid."

FIG. 3B depicts an illustrative lifting sheet 350 that may be used for the purposes of rotating a subject according to the methods described herein as an alternative to the multi-use strap 300 depicted in FIG. 3A. As shown in FIG. 3B, the lifting sheet 350 is generally a flat sheet of material that is positionable under a subject (e.g., subject 102 depicted in FIG. 1). Illustrative examples of the lifting sheet 350 are the Liko® RepoSheet® lift aid and the Liko® Solo™ RepoSheet® lift aid, both of which are available from Hillrom (Batesville, Ind.).

Still referring to FIG. 3B, the lifting sheet 350 is a sheet of material having a first side edge 360 (e.g., a first end) extending laterally and spaced apart from a second side edge 370, thereby defining an upper edge 380 spaced apart from a lower edge 390 (e.g., a second end opposite the first end). The lateral distance between the first side edge 360 and the second side edge 370 of the lifting sheet 350 is not limited by the present disclosure and may generally be any length, particularly lengths that are suitable for the purposes of rotating a subject according to the methods described herein. For example, the lateral distance between the first side edge 360 and the second side edge 370 of the lifting sheet 350 may be less than about 75 cm, about 75 cm, about 80 cm, about 85 cm, about 90 cm, about 95 cm, about 100 cm, about 105 cm, about 110 cm, about 115 cm, about 120 cm, greater than about 120 cm, or any value or range between any two of these values. In some embodiments, the lateral distance between the first side edge 360 and the second side edge 370 of the lifting sheet 350 may be such that, when a subject is arranged with respect to the lifting sheet 350 as described herein, the lifting sheet 350 extends a distance laterally from the subject on both sides of the subject. That is, the lateral distance between the first side edge 360 and the second side edge 370 of the lifting sheet 350 is longer than a lateral width of a subject at a location where the multi-use strap is positioned, as described in greater detail herein.

In embodiments, the lifting sheet 350 may have a height that extends between the upper edge 380 and the lower edge 390. The height of the lifting sheet 350 is not limited by the present disclosure. In some embodiments, the height of the lifting sheet 350 may correspond to a length of the person support apparatus 110 (FIG. 1). That is, the lifting sheet 350 may extend across the entire person support apparatus 110 (FIG. 1). In some embodiments, the height of the lifting sheet 350 may be such that when a subject is placed on the lifting sheet 350, the lifting sheet extends at least about 90% of the subject's height, including about 90% of the subject's height, about 95% of the subject's height, about 100% of the subject's height, greater than the subject's height, or any value or range between any of these values. In some embodiments, the height of the lifting sheet 350 may be about 1.5 meters, about 1.6 meters, about 1.7 meters, about 1.8 meters, about 1.0 meters, about 2.0 meters, or any value or range between any two of these values (including endpoints).

Still referring to FIG. 3B, the general shape of the lifting sheet 350 is not limited by the present disclosure, and may be any shape. For example, as depicted in the embodiment of FIG. 3B, the lifting sheet 350 has a generally rectangular shape. Certain shapes that allow for ease of use in placing the lifting sheet 350 underneath a subject are also contemplated.

The lifting sheet 350 may generally be constructed of any type of material, and such materials are not limited by the present disclosure. In some embodiments, the lifting sheet 350 may be constructed of a material that has strength properties allowing the lifting sheet 350 to support the weight of an average human subject. In some embodiments, the lifting sheet 350 may formed from a textile comprising natural fibers such as, for example, wool, flax, cotton, hemp, or the like. In some embodiments, the lifting sheet 350 may be formed from one or more synthetic fibers such as, for example, polyester, aramid, acrylic, nylon, spandex, olefin, carbon fiber, or the like.

The lifting sheet 350 generally includes a plurality of loops coupled to or integrated with the material of the lifting sheet 350. For example, as depicted in the embodiment of FIG. 3B, the lifting sheet 350 includes a plurality of loops 352 extending from the first side edge 360 and the second side edge 370 of the lifting sheet 350. Each one of the plurality of loops may be a length of material that extends from the lifting sheet and forms one or more openings 354, 356, 358 that are shaped, sized and configured to be placed over connection points of a sling bar, as described in greater detail herein. For example, in the embodiment depicted in FIG. 3B, each of the plurality of loops 352 includes three openings (e.g., a first opening 354, a second opening 356, and a third opening 358), each of which is shaped, sized, and configured to receive a connection point of a sling bar (e.g., sling bar 210 depicted in FIG. 1). In some embodiments, each of the openings 354, 356, 358 of each one of the plurality of loops 352 may be positioned a particular distance away from the lifting sheet 350. For example, each of the first openings 354 may be positioned a first distance away from the lifting sheet 350, representing the furthest distance of the openings. Each of the second openings 356 may be positioned a second distance away from the lifting sheet 350 and each of the third openings 358 may be positioned a third distance away from the lifting sheet 350, representing a closest distance to the lifting sheet 350. The varying lengths of the openings 354, 356, 358 provides an adjustable total usable length of the lifting sheet 350, depending on which opening is connected. For example, if the lifting sheet 350 is connected via the third openings 358, the total usable length of the lifting sheet 350 is less than a total usable length of the lifting sheet 350 when connected via the second openings 356 or the first openings 354. While three openings 354, 356, 358 are depicted on each loop 352 in the embodiment of FIG. 3B, the present disclosure is not limited to such. That is, each loop 352 may have greater or fewer openings without departing from the scope of the present disclosure.

Still referring to FIG. 3B, the plurality of loops 352 may be distributed along the height of each of the first side edge 360 and the second side edge 370. In some embodiments, the plurality of loops 352 may be positioned equidistant from one another along the first side edge 360 and the second side edge 370. In other embodiments, the plurality of loops 352 may not be positioned equidistant from one another. In some embodiments, the plurality of loops 352 may be positioned in clusters along the first side edge 360 and along the second side edge 370, the clusters representing areas where particular support of the subject may be needed or desired. For example, a first cluster of loops 352 may be positioned around where a subject's shoulders and upper arms would be located when positioned on the lifting sheet 350 and a second cluster of loops 352 may be positioned around where a subject's hips would be located when positioned on the lifting sheet 350. In some embodiments, the plurality of loops 352 may be positioned such that a first loop 352 in a particular location on the first side edge 360 of the lifting sheet 350 has a corresponding second loop 352 in a particular location on the second side edge 370 of the lifting sheet 350. That is, both the first loop 352 located on the first side edge 360 and the second loop 352 located on the second side edge 370 are located substantially the same distance from the upper edge 380 and the lower edge 390.

Each of the plurality of loops 352 are coupled to the material of the lifting sheet 350 by any means of coupling, including, but not limited to, stitching, welding, use of fasteners (e.g., rivets or the like), use of adhesives, and/or the like. In some embodiments, the loops 352 are integrated with the material of the lifting sheet 350. That is, the loops 352 are formed as an extension of the material of the lifting sheet 350 such that the lifting sheet 350 (including the loops 352) are all formed from a single piece of material.

The loops 352 may generally be constructed of any type of material, and such materials are not limited by the present disclosure. In some embodiments, the loops 352 may be constructed of a material that has strength properties that allow the lifting sheet 350, together with the loops 352, to support the weight of an average human subject. In some embodiments, the loops 352 may formed from a textile comprising natural fibers such as, for example, wool, flax, cotton, hemp, or the like. In some embodiments, the loops 352 may be formed from one or more synthetic fibers such as, for example, polyester, aramid, acrylic, nylon, spandex, olefin, carbon fiber, or the like. In some embodiments, the loops 352 may be formed of the same material as the material used for the remainder of the lifting sheet 350. In other embodiments, the loops 352 may be formed from a different material than the material used for the remainder of the lifting sheet 350.

It should be understood that the loops 352 depicted in FIG. 3B are merely one illustrative embodiment. In some embodiments, each of the loops 325 may be replaced by a pair of long and short loops, similar to the loops depicted in the embodiment of FIG. 3A. In some embodiments, the lifting sheet 350 may have a plurality of openings at each of the first side edge 360 and the second side edge 370 thereof, the plurality of openings reinforced (e.g., by use of a grommet or the like) and sized such that the openings can be placed over connection points on the sling bar 210 (FIG. 1). In some embodiments, each one of the various loops 352 of the lifting sheet 350 may be a single loop, and each loop may be substantially the same size. Other types of loops and/or means of providing connection points on the sling bar 210 (FIG. 1) are also contemplated.

The various components that are used for rotating a subject should now be generally understood. Turning to the remaining figures, FIG. 4 shows a flow diagram of an illustrative method of preparing the various components described herein for rotating a subject, while FIGS. 5A-5D, 6A-6B, and 7A-7C schematically depict various steps of the method. FIG. 8 shows a flow diagram of an illustrative method of rotating the subject using the components described herein, while FIGS. 9A-9F schematically depict various steps of the method.

The various processes described with respect to FIG. 4 are generally completed by one or more caregivers, such as, for example, the first individual 100*a* and the second individual 100*b* depicted in FIG. 1. The description with respect to FIG. 4 generally relates to two caregivers, but it should be understood that fewer or greater caregivers may also complete the various processes described with respect to FIG. 4 without departing from the scope of the present disclosure. Further, while FIGS. 5A-5D, 6A-6B, and 7A-7C depict the subject 102 being prepared for rotation from a supine position to a prone position, the subject may also be prepared for rotation from a prone position to a supine position using the same processes described with respect to FIG. 4. Further, while the embodiments of FIGS. 5A-5B and 6A-6B depict the multi-use straps 300 as the lifting aid used to rotate the subject 102 and FIGS. 5C-5D and 7A-7C depict the lifting sheet 350 as the lifting aid used to rotate the subject 102, any other lifting aid may also be used.

Referring to FIGS. 1 and 4, a determination may be made at block 402 as to which side of the support surface 116 the subject 102 will be turned toward. As will be evident from the description that follows, the side of the support surface 116 to which the subject 102 will be turned (e.g., the left side of the support surface 116 or the right side of the support surface 116) dictates the positioning of the multi-use straps 300, as well as which loops to connect to the sling bar 210. Still referring to FIGS. 1 and 4, it may further be necessary to ensure that the subject 102 and/or others (e.g., family members, caregivers, students, etc.) understand the process of rotating the subject. As such, the procedure may be explained to the subject and others at block 404.

In order to ensure a stable surface before rotating the subject 102, it may be necessary to determine if the wheels or casters 118 are unlocked at block 406. If the wheels or casters 118 are unlocked, the method proceeds to block 408, where the casters are locked. Otherwise, the method proceeds to block 410.

At block 410, the height of the support surface 116 may be adjusted. That is, the foot pedal or other control is actuated, thereby causing the plurality of lift members 114 to raise or lower the support surface 116 to a height that allows the first individual 100*a* and/or the second individual 100*b* to rotate the subject 102 as described herein. In some embodiments, the height of the support surface 116 may be adjusted to a height that represents a best ergonomic advantage for the first individual 100*a* and/or the second individual 100*b*, which may be about elbow height for the first individual 100*a* and/or the second individual 100*b*.

Since it may be advantageous to lower the side rails 120 of the person support apparatus 110 to allow better access to the subject 102 by the first individual 100*a* and/or the second individual 102*b*, at block 412, a determination may be made as to whether the side rails 120 are raised. Such a determination at block 412 may include determining whether the head rails and/or the intermediate side rails are raised. If the side rails 120 are raised, the process proceeds to block 414 where the side rails 120 are lowered. Once the side rails 120 are lowered, the process proceeds to block 416.

Some subjects that are being rotated may be attached to medical equipment, such as, for example, tubing, leads, lines, braces, and/or the like. For example, a subject in need of breathing assistance may have a tracheostomy tube inserted in his or her airway, the tracheostomy tube fluidly coupled to a ventilator that provides pressurized air (e.g., oxygen). In another example, a subject being monitored for heart and/or brain activity may have a plurality of leads attached to his or her skin. Subjects incapable of eating or drinking may have a central venous catheter fluidly coupled via tubing to an IV fluid source. Such subjects must be carefully rotated to ensure the tubing, leads, lines, braces, and/or the like do not become dislodged, kinked, disconnected, cause injury, and/or the like. Further, care must be taken to ensure the tubing, leads, lines, braces, and/or the like do not hinder rotation of the subject. As such, a determination may be made at block 416 as to whether such tubing, leads, lines, braces, and/or the like is connected to the subject 102 and/or must remain connected to the subject 102 during the rotation process. If tubing, leads, lines, braces, and/or the like are connected to the subject, the process moves to block 418. Otherwise, the process moves to block 420.

At block 418, the various tubing, leads, lines, braces, and/or the like are adjusted. In some embodiments, the tubing, leads, lines, braces, and/or the like may be adjusted by temporarily disconnecting and/or removing the tubing, leads, lines, braces, and/or the like for the duration of the rotation process. In some embodiments, particularly embodiments where the tubing, leads, lines, braces, and/or the like cannot or should not be disconnected and/or removed, the tubing, leads, lines, braces, and/or the like may be moved to a position where they will not hinder rotation of the subject and/or to a position where they will not or are less likely to become dislodged, kinked, disconnected, cause injury, and/or the like. In some embodiments, movement according to block 418 may be to the side of the person support apparatus 110 toward which the subject 102 will be turned, as determined at block 402 (e.g., the "turn toward" side). For example, if it is determined that the subject 102 will be turned toward the left hand side of the person support apparatus 110, the tubing, leads, lines, braces, and/or the like (as well as any equipment attached thereto) may be moved to the left hand side of the person support apparatus 110. In another example, if it is determined that the subject 102 will be turned toward the right hand side of the person support apparatus 110, the tubing, leads, lines, braces, and/or the like (as well as any equipment attached thereto) may be moved to the right hand side of the person support apparatus 110. It should be understood that block 418 is optional, particularly for some longer tubing, leads, lines, braces, and/or the like where it may not be necessary to move them.

Referring now to FIGS. 1, 4, and 5A-5B, the lifting aid (e.g., the plurality of multi-use straps 300 or the lifting sheet 350) may be positioned underneath the subject 102 at block 420. That is, the lifting aid may be positioned between the subject 102 and the person support apparatus 110. In some embodiments, the lifting aid may be pre-placed on the person support apparatus 110 prior to the subject 102 being placed on the person support apparatus 110. In such embodiments, the subject 102 and/or the lifting aid may be adjusted for positioning at block 420, as described herein.

Figure 5A:
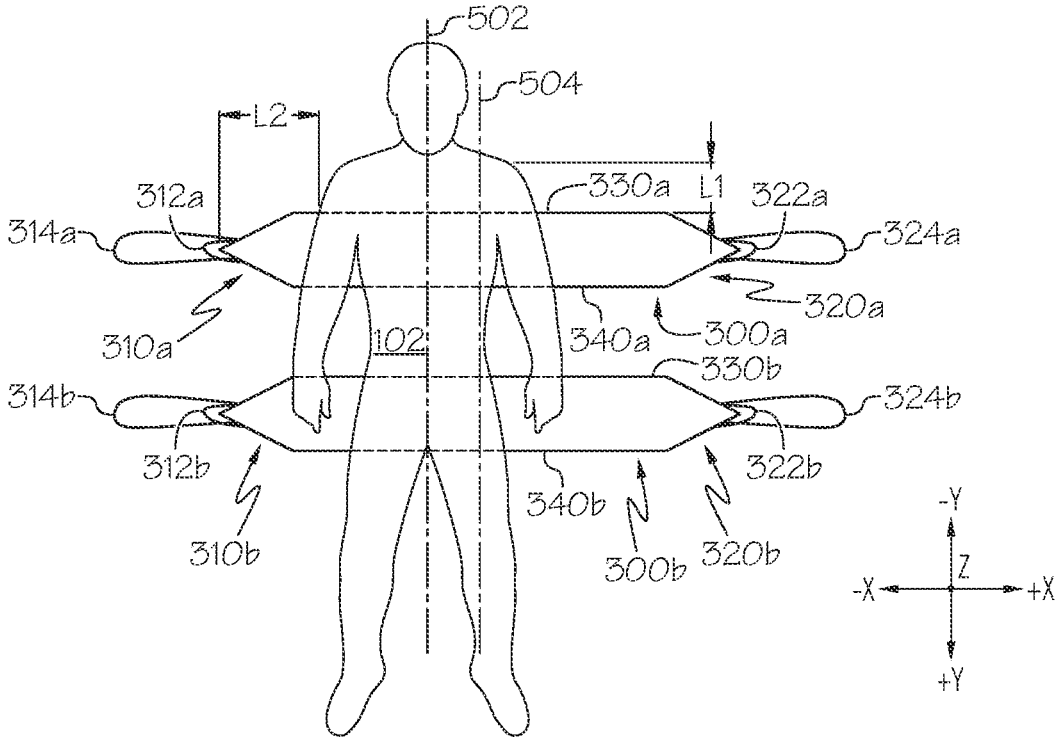
FIG. 5A schematically depicts an illustrative positioning of a subject being offset relative to a plurality of multi-use straps according to one or more embodiments shown and described herein.
Figure 5B:
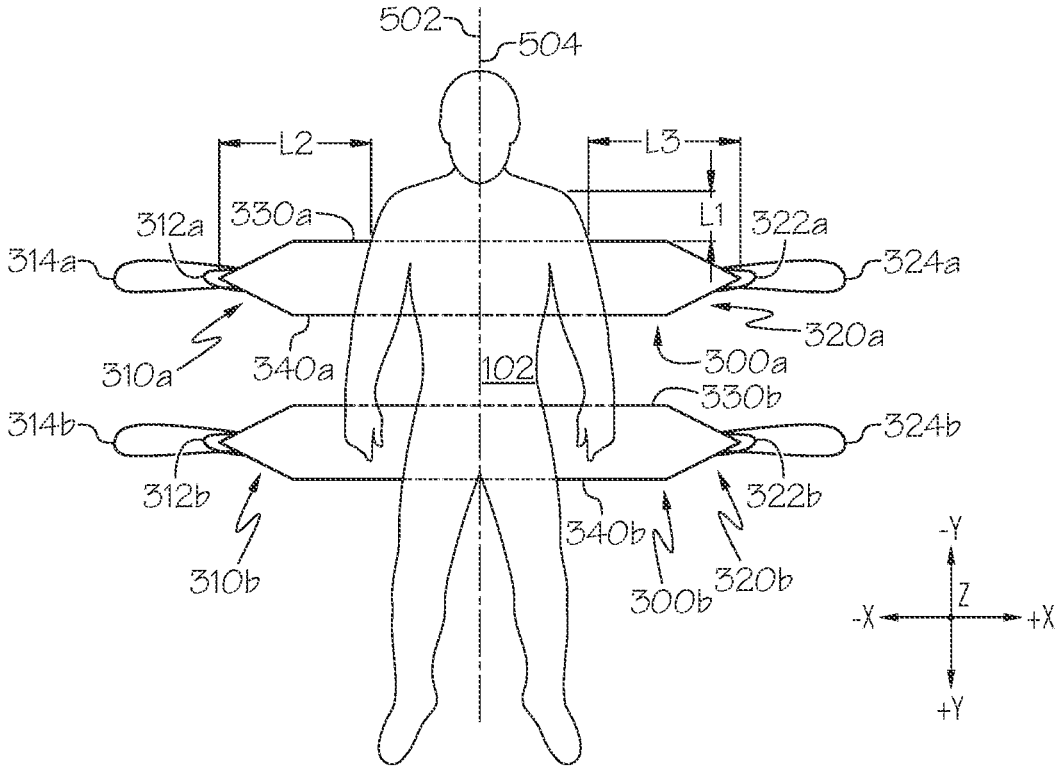
FIG. 5B schematically depicts an illustrative positioning of a subject being centered relative to a plurality of multi-use straps according to one or more embodiments shown and described herein.

In embodiments where a plurality of multi-use straps 300 are used, such as the embodiment depicted in FIGS. 1 and 5A-5B, the multi-use straps 300 may be particularly positioned with respect to the subject 102 in order to achieve rotation of the subject 102 according to the present disclosure. In some embodiments, such a positioning may be based on the type of loops coupled to the multi-use straps 300, the relative length of loops coupled to the multi-use straps 300, and/or lengths of the loops to be coupled to the sling bar 110, as described in greater detail herein. As depicted in the embodiments of FIGS. 5A-5B, a first multi-use strap 300*a* may be placed such that the first multi-use strap 300*a* extends laterally across the subject 102 in a location that is superior relative to a second multi-use strap 300*b* that also extends laterally across the subject 102 (e.g., located in the −y direction of the coordinate axes of FIGS. 5A-5B). More specifically, the first multi-use strap 300*a* may be positioned such that the upper edge 330*a* and the lower edge 340*a* of the first multi-use strap 300*a* extends in a lateral direction and is positioned at a location that is at or inferior to a shoulder of the subject 102, as depicted in the embodiments of FIGS. 5A-5B. In some embodiments, the upper edge 330*a* and/or the lower edge 340*a* of the first multi-use strap 300*a* may be positioned longitudinally between a shoulder and an armpit of the subject 102. In particular embodiments, the upper edge 330*a* of the first multi-use strap 300*a* may be positioned longitudinally such that the upper edge 330*a* is a first length L1 that is about 1 cm to about 15 cm from the top of a shoulder of the subject 102, including about 1 cm from the top of the shoulder, about 2 cm from the top of the shoulder, about 3 cm from the top of the shoulder, about 4 cm from the top of the shoulder, about 5 cm from the top of the shoulder, about 6 cm from the top of the shoulder, about 7 cm from the top of the shoulder, about 8 cm from the top of the shoulder, about 9 cm from the top of the shoulder, about 10 cm from the top of the shoulder, about 11 cm from the top of the shoulder, about 12 cm from the top of the shoulder, about 13 cm from the top of the shoulder, about 14 cm from the top of the shoulder, about 15 cm from the top of the shoulder, or any value or range between any two of these values (including endpoints). The second multi-use strap 300*b* may be positioned such that the upper edge 330*b* of the second multi-use strap 300*b* extends in a lateral direction (e.g., parallel to the first multi-use strap 300*a*) and is longitudinally positioned at a location that is at or near a greater trochanter of the subject 102, as depicted in the embodiments of FIG. 5A-5B. In some embodiments, the second multi-use strap 300*b* may be positioned such that the upper edge 330*b* of the second multi-use strap 300*b* and the lower edge 340*b* of the second multi-use strap 300*b* are longitudinally located between a waist of the subject 102 and a knee of the subject 102.

Referring to FIG. 5A, the first multi-use strap 300*a* may further be positioned such that the first end 310*a* thereof is located a second length L2 from a widest lateral part of the subject 102 (e.g., an arm of the subject 102, a shoulder of the subject 102, a torso of the subject 102, or the like) in the area where the first multi-use strap 300*a* is located with respect to the subject 102. The first multi-use strap 300*a* may also be positioned such that the second end 320*a* thereof is located a third length L3 from the widest lateral part of the subject 102 (e.g., an arm of the subject 102, a shoulder of the subject 102, a torso of the subject 102, or the like) in the area where the first multi-use strap 300*a* is located. The second multi-use strap 300*b* is generally laterally aligned with the first multi-use strap 300*b*, as shown in FIG. 5A. In the embodiment depicted in FIG. 5A where the subject 102 is to be turned toward a right of the person support apparatus 110 and the multi-use straps 300*a*, 300*b* (e.g., in the +x direction of the coordinate axes of FIG. 5A), the second length L2 may be shorter than the third length L3. That is, the subject 102 is positioned off-center on the first multi-use strap 300*a* and the second multi-use strap 300*b* such that a midline 502 of the subject is positioned to the left of a centerline 504 of the multi-use straps 300*a*, 300*b* and such that a greater distance exists between the side of the first multi-use strap 300*a* and the second multi-use strap 300*b* towards which the subject 102 is to be turned. Accordingly, in other embodiments where the subject 102 is to be turned toward a left of the person support apparatus 110 (e.g., in the −x direction of the coordinate axes of FIG. 5A), the second length L2 may be longer than the third length L3 such that the midline 502 is positioned to the right of the centerline 504. The second length L2 and third length L3 are generally not limited by the present disclosure, and may each be any length. In some embodiments, the second length L2 and the third length L3 may be such that the midline 502 of the subject 102 is about 15 cm (6 inches) off center from the centerline 504 of the first multi-use strap 300*a* between the first end 310*a* and the second end 320*a* (and the second multi-use strap 300*b* between the first end 310*b* and the second end 320*b*). In some embodiments, the second length L2 and the third length L3 may be such that the midline 502 of the subject 102 is about 61 cm (24 inches) off center from the centerline 504 of the first multi-use strap 300*a* between the first end 310*a* and the second end 320*a* (and the second multi-use strap 300*b* between the first end 310*b* and the second end 320*b*). In embodiments where the subject 102 is to be turned toward the right (e.g., in the +x direction of the coordinate axes of FIG. 5A), the second length L2 may be x centimeters and the third length L3 may be x+y centimeters, where x and y are any value and x+y is equal to the width of the first multi-use strap 300*a* minus the lateral width of the subject at the widest point in an area where the first multi-use strap 300*a* extends. For example, if the first multi-use strap 300*a* is 90 cm in length and the subject is 40 cm wide in a lateral direction at the widest point in an area where the first multi-use strap 300*a* extends (e.g., at the shoulders), then x+y is 50 cm. Further, if the subject is to be turned toward the right (e.g., in the +x direction of the coordinate axes of FIG. 5A such that the second length L2 (*x*) is less than the third length L3 (*y*), then x may be any value between 0 and 24 cm and y may be any value between 26 cm and 50 cm.

The offset positioning of the subject 102 relative to the first multi-use strap 300*a* and the second multi-use strap 300*b* is generally completed for the purposes of facilitating rotation, as described in greater detail herein. In embodiments where the multi-use straps 300*a*, 300*b* have loops that are all substantially equal lengths, it may be necessary to position the subject 102 offset from the multi-use straps 300*a*, 300*b*, as depicted in FIG. 3A. However, in embodiments where the multi-use straps 300*a*, 300*b* have loops of varying lengths, such an "offset" may be achieved even when the midline 502 of the subject 120 is aligned with the centerline 504 of the multi-use straps 300*a*, 300*b*, as depicted in FIG. 5B. This is achieved by connecting the longer loops on one side of the multi-use straps 300*a*, 300*b* and the shorter loops on the other side of the multi-use straps 300*a*, 300*b* to a sling bar, as described in greater detail herein. It should be understood that the offset positioning depicted in FIG. 5A can still be used when the longer loops on one side of the multi-use straps 300*a*, 300*b* and the shorter loops on the other side of the multi-use straps 300*a*, 300*b* are connected to a sling bar, but such an offset positioning may be optional and/or based on the size of the subject 102.

Referring again to FIGS. 5A and 5B, the second lifting strap 300*b* may generally be laterally aligned with the first lifting strap 300*a*. That is, the first end 310*b* of the second lifting strap 300*b* may generally be laterally aligned with the first end 310*a* of the first lifting strap 300*a* and the second end 320*b* of the second lifting strap 300*b* may generally be laterally aligned with the second end 320*a* of the first lifting strap 300*a* in embodiments where the second lifting strap 300*b* has the same dimensions as the first lifting strap 300*a*.

Figure 5C:
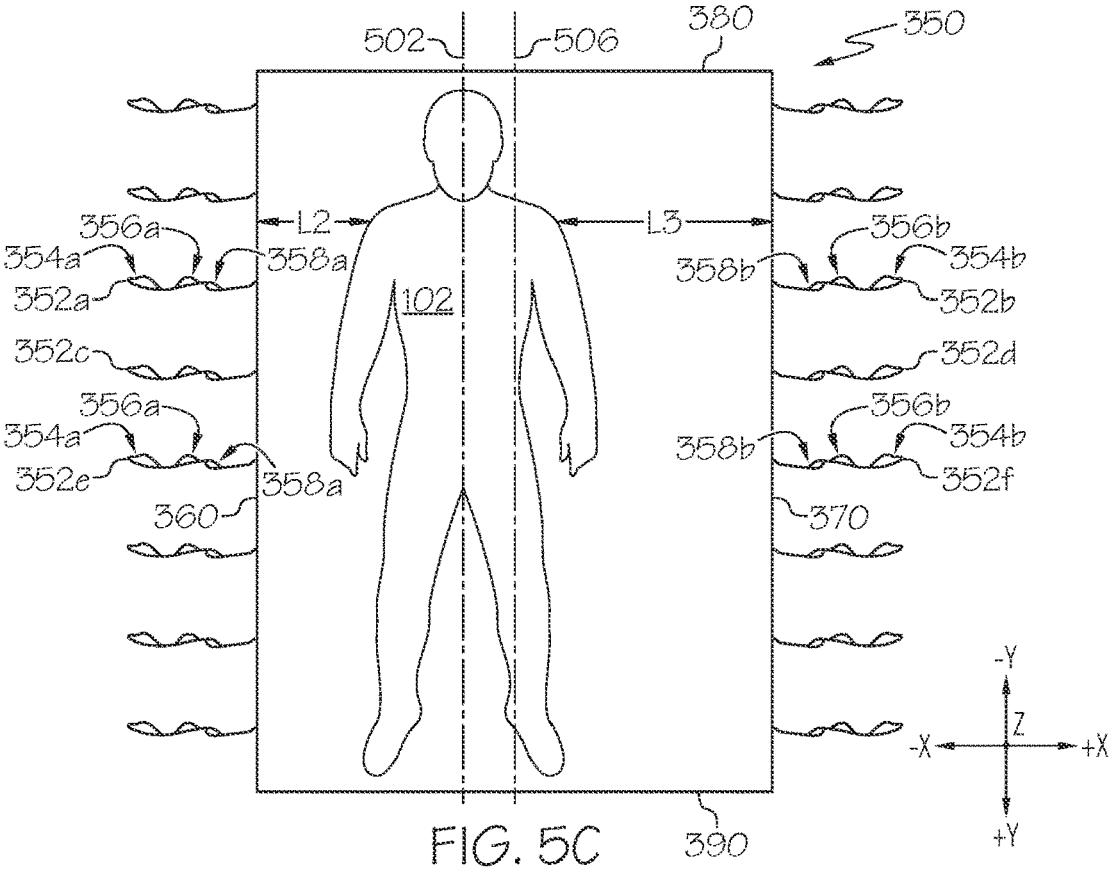
FIG. 5C schematically depicts an illustrative positioning of a subject being offset relative to a lifting sheet according to one or more embodiments shown and described herein.
Figure 5D:
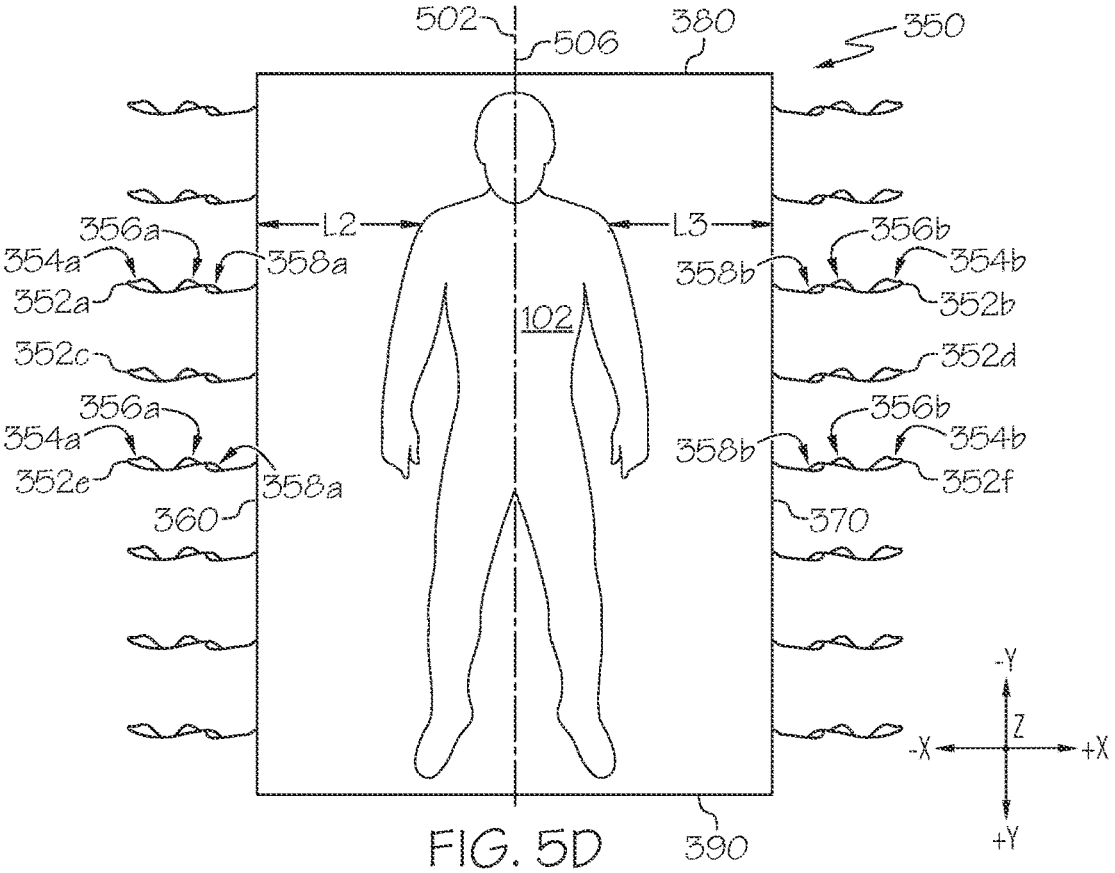
FIG. 5D schematically depicts an illustrative positioning of a subject being aligned relative to a lifting sheet according to one or more embodiments shown and described herein.

In embodiments where a lifting sheet 350 is used, such as the embodiment depicted in FIGS. 5C-5D, the lifting sheet 350 may be particularly positioned with respect to the subject 102 in order to achieve rotation of the subject 102 according to the present disclosure. As depicted in the embodiments of FIG. 5C-5D, the lifting sheet 350 may be positioned such that a first loop 352*a* coupled to the first side edge 360 and a corresponding second loop 352*b* coupled to the second side edge 370 extend in a lateral direction and are longitudinally aligned at a location that is at or inferior to a shoulder of the subject 102. In some embodiments, the first loop 352*a* and the second loop 352*b* may be longitudinally aligned with a point located between a shoulder and an armpit of the subject 102. In particular embodiments, the first loop 352*a* and the second loop 352*b* may be longitudinally aligned with a point that is located about 1 cm to about 15 cm from the top of a shoulder of the subject 102, including about 1 cm from the top of the shoulder, about 2 cm from the top of the shoulder, about 3 cm from the top of the shoulder, about 4 cm from the top of the shoulder, about 5 cm from the top of the shoulder, about 6 cm from the top of the shoulder, about 7 cm from the top of the shoulder, about 8 cm from the top of the shoulder, about 9 cm from the top of the shoulder, about 10 cm from the top of the shoulder, about 11 cm from the top of the shoulder, about 12 cm from the top of the shoulder, about 13 cm from the top of the shoulder, about 14 cm from the top of the shoulder, about 15 cm from the top of the shoulder, or any value or range between any two of these values (including endpoints). Other loops of the plurality of loops that are located in an inferior direction from the first loop 352*a* and the second loop 352*b* (e.g., in the +y direction of the coordinate axes of FIGS. 5C-5D) may also be particularly located with respect to the subject 102 to ensure the lifting sheet 350 adequately supports the subject. For example, a third loop 352*c* located on the first side edge 360 and a corresponding fourth loop 352*d* located on the second side edge 370 may be positioned such that they are generally longitudinally aligned with a waist of the subject 102. In another example, a fifth loop 352*e* located on the first side edge 360 and a sixth loop 352*f* located on the second side edge 370 may be positioned such that they are generally longitudinally aligned with a greater trochanter of the subject 102, as depicted in the embodiments of FIG. 5C-5D. In some embodiments, the fifth loop 352*e* and the sixth loop 352*f* may be positioned such that they are generally aligned between a waist of the subject 102 and a knee of the subject 102.

Referring to FIG. 5C, the lifting sheet 350 may further be positioned such that the first side edge 360 thereof is located a second length L2 from a widest lateral part of the subject 102 (e.g., an arm of the subject 102, a shoulder of the subject 102, a torso of the subject 102, or the like) in the area where the lifting sheet 350 is located with respect to the subject 102. The lifting sheet 350 may also be positioned such that the second side edge 370 thereof is located a third length L3 from the widest lateral part of the subject 102 (e.g., an arm of the subject 102, a shoulder of the subject 102, a torso of the subject 102, or the like) in the area where the lifting sheet 350 is located. In some embodiments, the second length L2 and the third length L3 may be such that the midline 502 of the subject 102 is about 15 cm (6 inches) off center from the centerline 506 of the lifting sheet 350 between the first side edge 360 and the second side edge 370. In some embodiments, the second length L2 and the third length L3 may be such that the midline 502 of the subject 102 is about 61 cm (24 inches) off center from the centerline 506 of the lifting sheet 350 between the first side edge 360 and the second side edge 370. In the embodiment depicted in FIG. 5C where the subject 102 is to be turned toward a right of the person support apparatus 110 and the lifting sheet 350 (e.g., in the +x direction of the coordinate axes of FIG. 5C), the second length L2 may be shorter than the third length L3. That is, the subject 102 is positioned off-center on the lifting sheet 350 (e.g., the midline 502 of the subject 102 is located to the left of the centerline 506 of the lifting sheet 350) such that a greater distance exists between the subject 102 and the second side edge 370 relative to the distance between the subject 102 and the first side edge 360. Accordingly, in other embodiments where the subject 102 is to be turned toward a left of the person support apparatus 110 (e.g., in the −x direction of the coordinate axes of FIG. 5C), the second length L2 may be longer than the third length L3 (e.g., such that the midline 502 of the subject 102 is located to the right of the centerline 506 of the lifting sheet 350). The second length L2 and third length L3 are generally not limited by the present disclosure, and may each be any length. In embodiments where the subject 102 is to be turned toward the right (e.g., in the +x direction of the coordinate axes of FIG. 5C), the second length L2 may be x centimeters and the third length L3 may be x+y centimeters, where x and y are any value and x+y is equal to the width of the lifting sheet 350 minus the lateral width of the subject at a line between the first loop 352*a* and the second loop 352*b*. For example, if the lifting sheet 350 is 90 cm in length and the subject is 40 cm wide in a lateral direction the location of an imaginary line between the first loop 352*a* and the second loop 352*b* (e.g., at the shoulders), then x+y is 50 cm. Further, if the subject is to be turned toward the right (e.g., in the +x direction of the coordinate axes of FIG. 5C such that the second length L2 ($x$) is less than the third length L3 ($y$), then x may be any value between 0 and 24 cm and y may be any value between 26 cm and 50 cm.

The offset positioning of the subject 102 relative to the lifting sheet 350 is generally completed for the purposes of facilitating rotation, as described in greater detail herein. In embodiments where the lifting sheet 350 has loops that are all substantially equal lengths, it may be necessary to position the subject 102 offset from the lifting sheet 350, as depicted in FIG. 3C. However, in embodiments where the lifting sheet 350 has loops of varying lengths, such an "offset" may be achieved even when the midline 502 of the subject 120 is aligned with the centerline 506 of the lifting sheet 350, as depicted in FIG. 5D. This is achieved by connecting the longer loops on one side of the lifting sheet 350 and the shorter loops on the other side of the lifting sheet 350 to a sling bar, as described in greater detail herein. It should be understood that the offset positioning depicted in FIG. 5C can still be used when the longer loops on one side of the lifting sheet 350 and the shorter loops on the other side of the lifting sheet 350 are connected to a sling bar, but such an offset positioning may be optional and/or based on the size of the subject 102.

Referring again to FIGS. 5C-5D, the upper edge 380 and the lower edge 390 of the lifting sheet 350 are generally arranged adjacent to the head and feet of the subject 102, respectively. The exact location of the upper edge 380 and the lower edge 390 are dependent on the anatomy of each individual and the arrangement of the various other portions of the lifting sheet 350 described herein. In some embodiments, the head of the subject 102 may extend beyond the upper edge 380, whereas in other embodiments, the head may not extend beyond the upper edge 380. Similarly, in some embodiments, the feet of the subject 102 may extend beyond the lower edge 390, whereas in other embodiments, the feet may not extend beyond the lower edge 390.

Referring again to FIGS. 1 and 4, once the lifting aid (e.g., the multi-use straps 300*a*, 300*b* or the lifting sheet 350) have been positioned with respect to the subject 102, the sling bar 210 may be lowered at block 422. The sling bar 210 may generally be lowered to a height above the support surface 116 that is sufficient to connect the loops of the multi-use straps 300*a*, 300*b* (FIGS. 5A-5B) or the loops of the lifting sheet 350 (FIGS. 5C-5D). Such a height may be referred to as a "connection height." In the embodiment depicted in FIG. 2A, the sling bar 210 may be lowered by a user by actuating one or more user interface controls 216 on the hand control unit 212. In the embodiment depicted in FIG. 2B, the sling bar 288 may be lowered by a user by actuating one or more user interface controls 256 on the hand control unit 252. In some embodiments, the sling bar 288 may be manually lowered. In embodiments where a plurality of sling bars are used, each of the plurality of sling bars may be lowered.

Figure 6A:
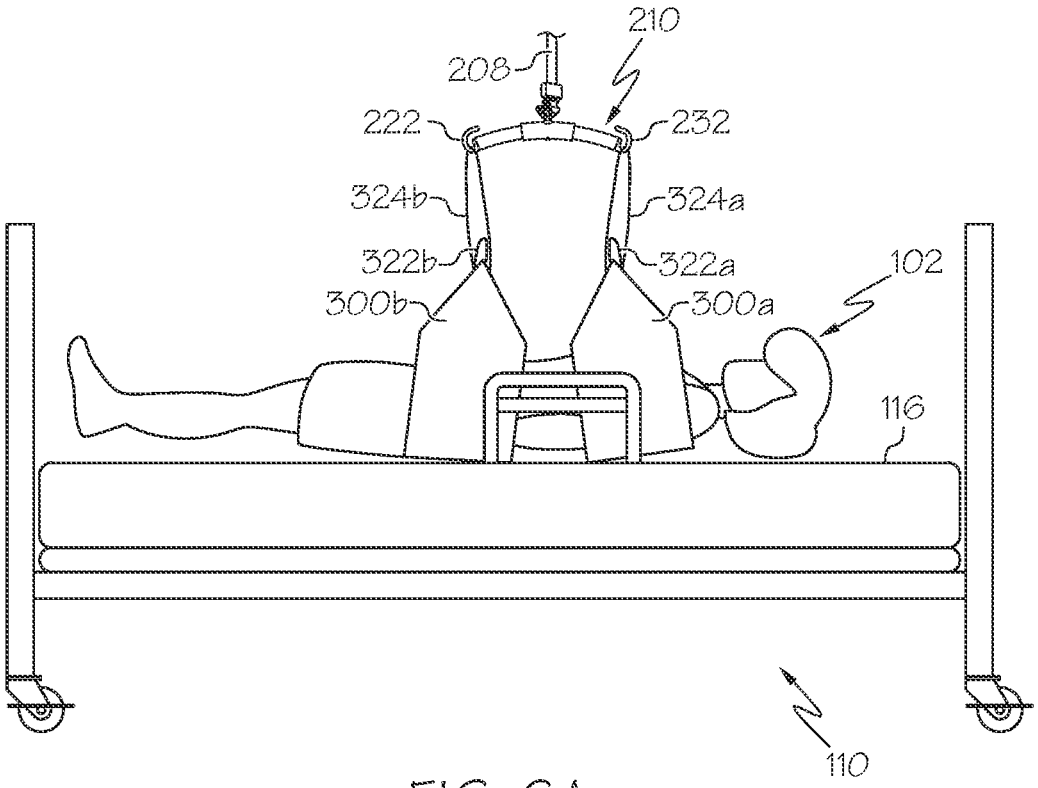
FIG. 6A schematically depicts a side view of a plurality of multi-use straps holding a subject and coupled to a sling bar of an overhead lift according to one or more embodiments shown and described herein.
Figure 6B:
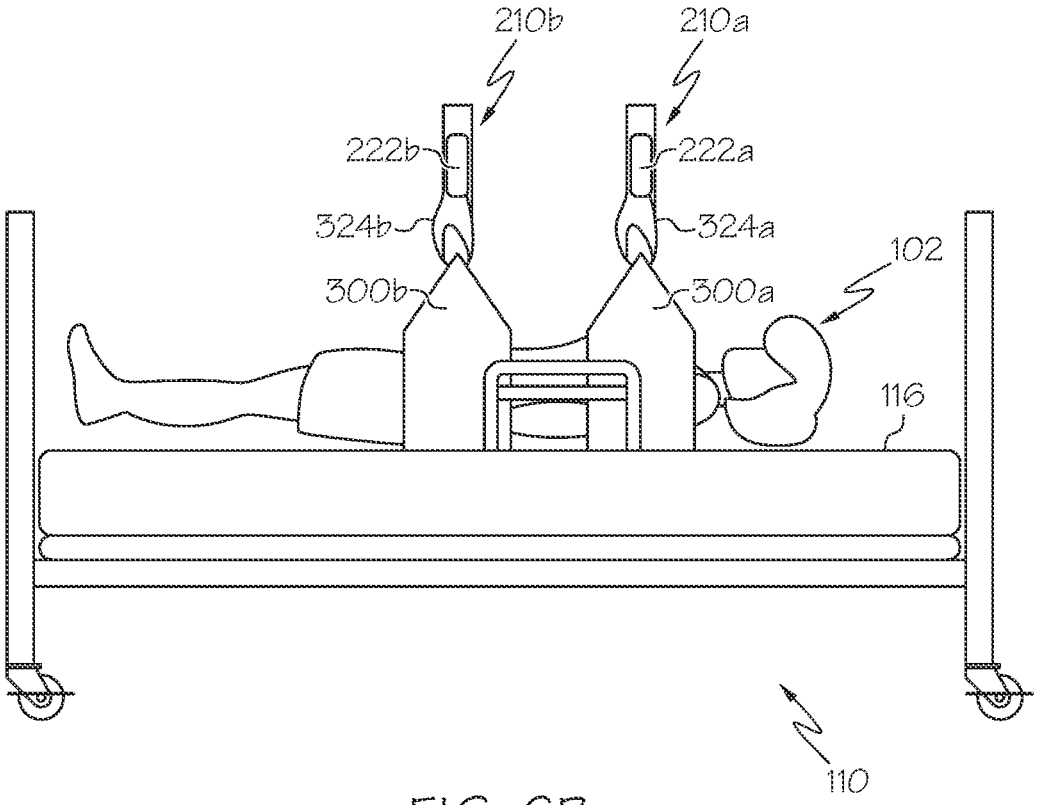
FIG. 6B schematically depicts a side view of a plurality of multi-use straps holding a subject and coupled to a plurality of sling bars of respective overhead lifts according to one or more embodiments shown and described herein.
Figure 7A:
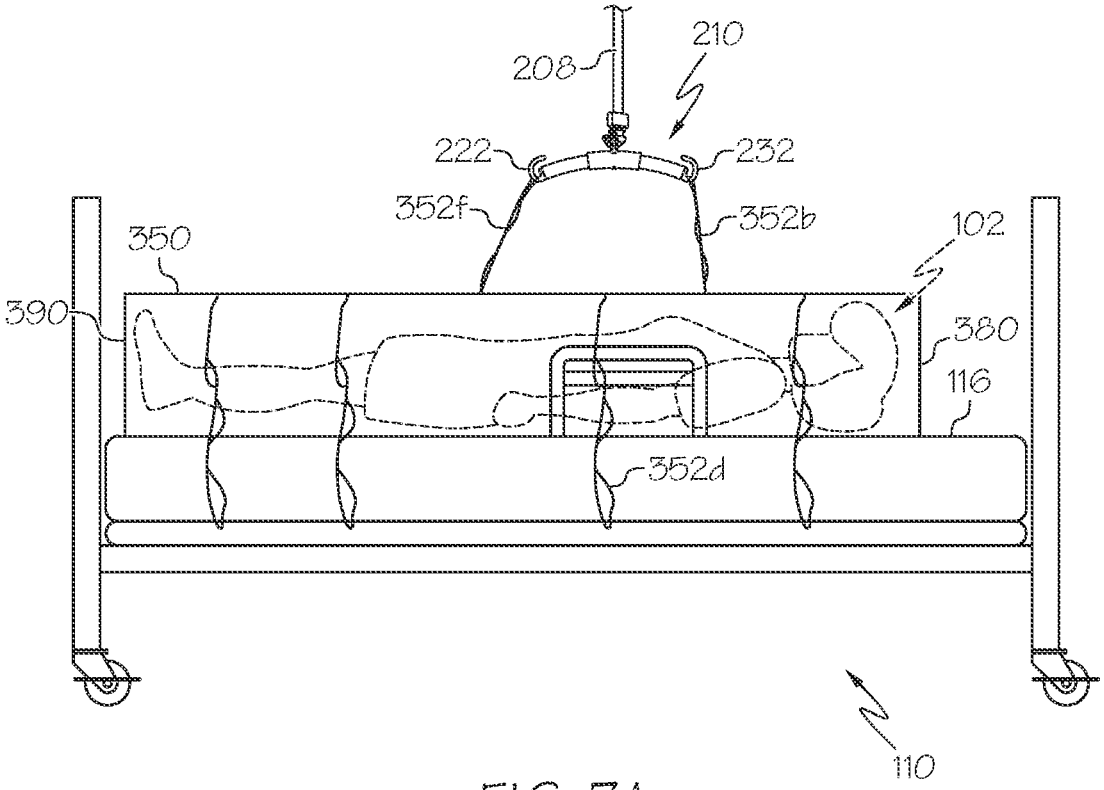
FIG. 7A schematically depicts a side view of a lifting sheet holding a subject and having four loops coupled to a sling bar according to one or more embodiments shown and described herein.
Figure 7B:
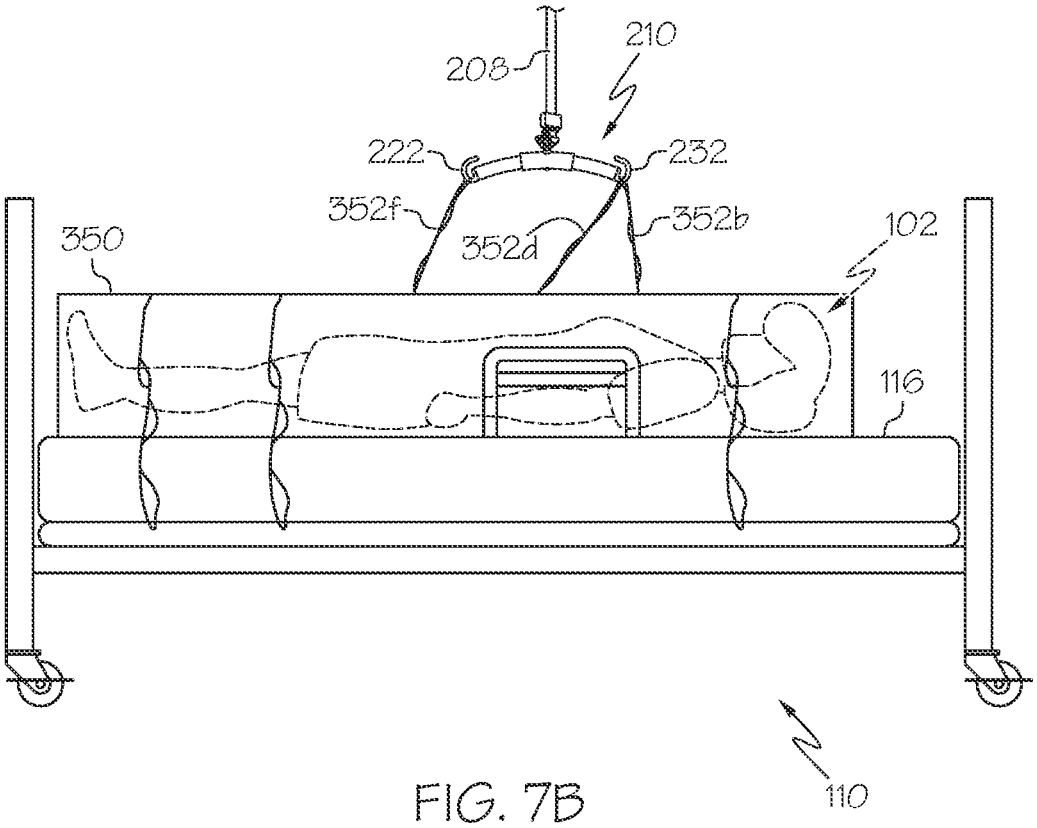
FIG. 7B schematically depicts a side view of a lifting sheet holding a subject and having six loops coupled to a sling bar according to one or more embodiments shown and described herein.

Referring to FIGS. 1, 4, 6A, and 7A-7B, the sling bar 210 is positioned at block 424. That is, the sling bar 210 is arranged with respect to the support surface 116 of the person support apparatus 110 and the multi-use straps 300*a*, 300*b* (FIG. 6A) or the lifting sheet 350 (FIGS. 7A-7B). As shown in FIGS. 6A and 7A-7B, the sling bar 210 is arranged such that the length L (FIG. 2A) of the sling bar 210 is substantially parallel to a sagittal plane of the subject 102. That is, the sling bar 210 is aligned in a lateral direction. Such a positioning of the sling bar 210 may be completed so that the various loops can be connected to the sling bar, as described herein. It should be understood that such an alignment is merely illustrative, and other arrangements and positioning of the sling bar 210 are contemplated. For example, in embodiments where a plurality of sling bars 210*a*, 210*b* are used (e.g., the embodiments of FIGS. 6B and 7C), each of the sling bars 210*a*, 210*b* may be arranged at block 424 such that the length L (FIG. 2A) of the sling bar 210 is substantially parallel to a transverse plane of the subject 102 (e.g., transverse to the sagittal plane of the subject). That is, the sling bar 210 is arranged in a longitudinal direction.

Referring to FIGS. 1, 3A-3B, 4, and 6A, various ones of the loops 312, 314, 322, 324 of the multi-use straps 300*a*, 300*b* or various ones of the loops 352 of the lifting sheet 350 are coupled to the sling bar 210 at block 426. That is, one or more loops 312, 314, 322, 324, 352 are placed such that the loops are held by the first retention component 222 or the second retention component 232 of the sling bar 210.

Placement of the loops 312, 314, 322, 324, 352 according to block 426 may be completed in a particular manner based on how the subject 102 is arranged on the lifting aid (e.g., the multi-use straps 300*a*, 300*b* or the lifting sheet 350) and the direction of rotation. In embodiments utilizing the plurality of multi-use straps 300*a*, 300*b*, the long loops 314, 324 may be attached on the side to which the subject 102 is being turned and the short loops 312, 322 may be attached on the opposite side. For example, turning to FIGS. 5A-5B and 6A, in embodiments where the subject 102 is to be turned toward the right side (e.g., turned in the +x direction of the coordinate axes of FIGS. 5A-5B), the second long loop 324*a* of the first multi-use strap 300*a* and the second long loop 324*b* of the second multi-use strap 300*b* are attached to the second retention component 232 and the first retention component 222, respectively, because the second long loops 324*a*, 324*b* are located on the "turn toward" side (e.g., the right side) as shown in FIGS. 5A-5B. Accordingly, the first short loop 312*a* of the first multi-use strap 300*a* and the first short loop 312*b* of the second multi-use strap 300*b* (hidden from view in FIG. 6A) are attached to the second retention component 232 and the first retention component 222, respectively, because the first long loops 314*a*, 314*b* are not located on the "turn toward" side (e.g., the left side) as shown in FIGS. 5A-5B. Such a connection of the loops in this manner may be completed regardless of whether the subject 102 is aligned as shown in FIG. 5A or FIG. 5B. However, if the subject 102 is aligned as described herein with respect to FIG. 5B, such a connection of the loops as described above is necessary to ensure the appropriate "offset" needed for rotating the subject 102. In embodiments where the subject 102 is aligned as depicted in FIG. 5A, loops of equal length may be coupled to the sling bar 210 (not depicted in FIG. 6A).

While not depicted in the figures herein, in embodiments where the subject 102 is to be turned toward the left side (e.g., in the −x direction of the coordinate axes of FIGS. 5A-5B), the first long loop 314*a* of the first multi-use strap 300*a* and the first long loop 314*b* of the second multi-use strap 300*b* (hidden from view in FIG. 6A) are attached to the second retention component 232 and the first retention component 222, respectively, and the second short loop 322*a* of the first multi-use strap 300*a* and the second short loop 322*b* of the second multi-use strap 300*b* are attached to the second retention component 232 and the first retention component 222, respectively.

Referring to FIGS. 5C-5D and 7A, in embodiments utilizing the lifting sheet 350, the openings on the loops 352 that are further away from the respective side edges 360, 370 (e.g., the first openings 354 or the second openings 356) may be attached on the side to which the subject 102 is being turned and the openings on the loops 352 that are closer to the respective side edges 360, 370 (e.g., the second openings 356 or third openings 358) may be attached on the opposite side. It should be understood that when the first openings 354 are used on one side, either the second openings 356 or the third openings 358 can be used on the other side and when the second openings 356 are used on one side, only the third openings 358 can be used on the other side when the subject 102 is arranged as depicted in FIG. 5D (or optionally when the subject 102 is arranged as depicted in FIG. 5C). For example, in embodiments where the subject 102 is to be turned toward the right side (e.g., turned in the +x direction of the coordinate axes of FIGS. 5C-5D), the first openings 354*b* (or optionally the second openings 356*b*, hidden from view in FIG. 7A) on the loops 352*b*, 352*f* coupled to the second side edge 370 are attached to the first retention component 222 of the sling bar 210 because the openings 354*b* provide for longer loops 352*b*, 352*f* on the "turn toward" side (e.g., the right side) as shown in FIGS. 5C-5D. Accordingly, the third openings 358*a* (or optionally the second openings 356*a* in embodiments where the first openings 354 are used on the opposite side, hidden from view in FIG. 7A) on the loops 352*a*, 352*e* coupled to the first side edge 360 are attached to the second retention component 232 of the sling bar 210. While not depicted in the figures herein, in embodiments where the subject 102 is to be turned toward the left side (e.g., in the −x direction of the coordinate axes of FIGS. 5C-5D), the first openings 354*a* (or optionally, the second openings 356*a*) are attached to the second retention component 232 of the sling bar 210, and the third openings 358*b* (or optionally, the second openings 356*b* in instances where the first openings 354*a* are used) are attached to the first retention component 222 of the sling bar 210. Such a connection of the loops in this manner may be completed regardless of whether the subject 102 is aligned as shown in FIG. 5C or FIG. 5D. However, if the subject 102 is aligned as described herein with respect to FIG. 5D, such a connection of the loops as described above is necessary to ensure the appropriate "offset" needed for rotating the subject 102. In embodiments where the subject 102 is aligned as depicted in FIG. 5C, loops of equal length may be coupled to the sling bar 210 (not depicted in FIG. 7A).

In the embodiment depicted in FIG. 7A (and also referring to FIGS. 5C-5D), loop 352*a* (hidden from view in FIG. 7A), and loop 352*b*, which represent loops that support a subject's shoulders, are connected to the second retention component 232 of the sling bar 210. In addition, loop 352*e* (hidden from view in FIG. 7A) and loop 352*f*, which represent loops that support a subject's hips, are connected to the first retention component 222 of the sling bar 210. Loop 352*c* (hidden from view in FIG. 7A) and loop 352*d*, in addition to other loops, remain not in contact with the sling bar 210. However, it should be understood that this is merely illustrative, and in other embodiments, more of the loops 352 coupled to the lifting sheet 350 may be connected to provide additional support. For example, in the embodiment depicted in FIG. 7B (and also referring to FIGS. 5C-5D), loop 352*c* (hidden from view in FIG. 7B) and loop 352*d* of the lifting sheet 350 may also be connected to the second retention component 232 of the sling bar 210. Alternatively, while not depicted, loop 352*c* (hidden from view in FIG. 7B) and loop 352*d* of the lifting sheet 350 may be connected to the first retention component 222 of the sling bar 210.

Figure 7C:
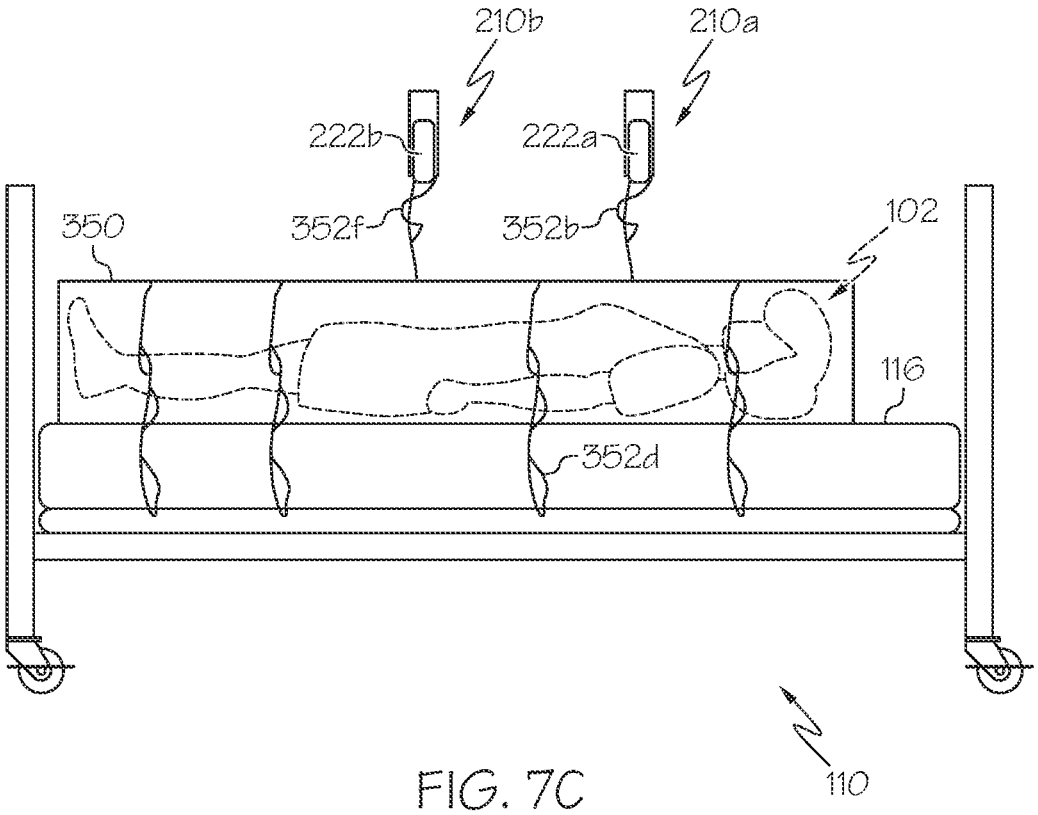
FIG. 7C schematically depicts a side view of a lifting sheet holding a subject and having four loops coupled to a plurality of sling bars according to one or more embodiments shown and described herein.
Figure 8:
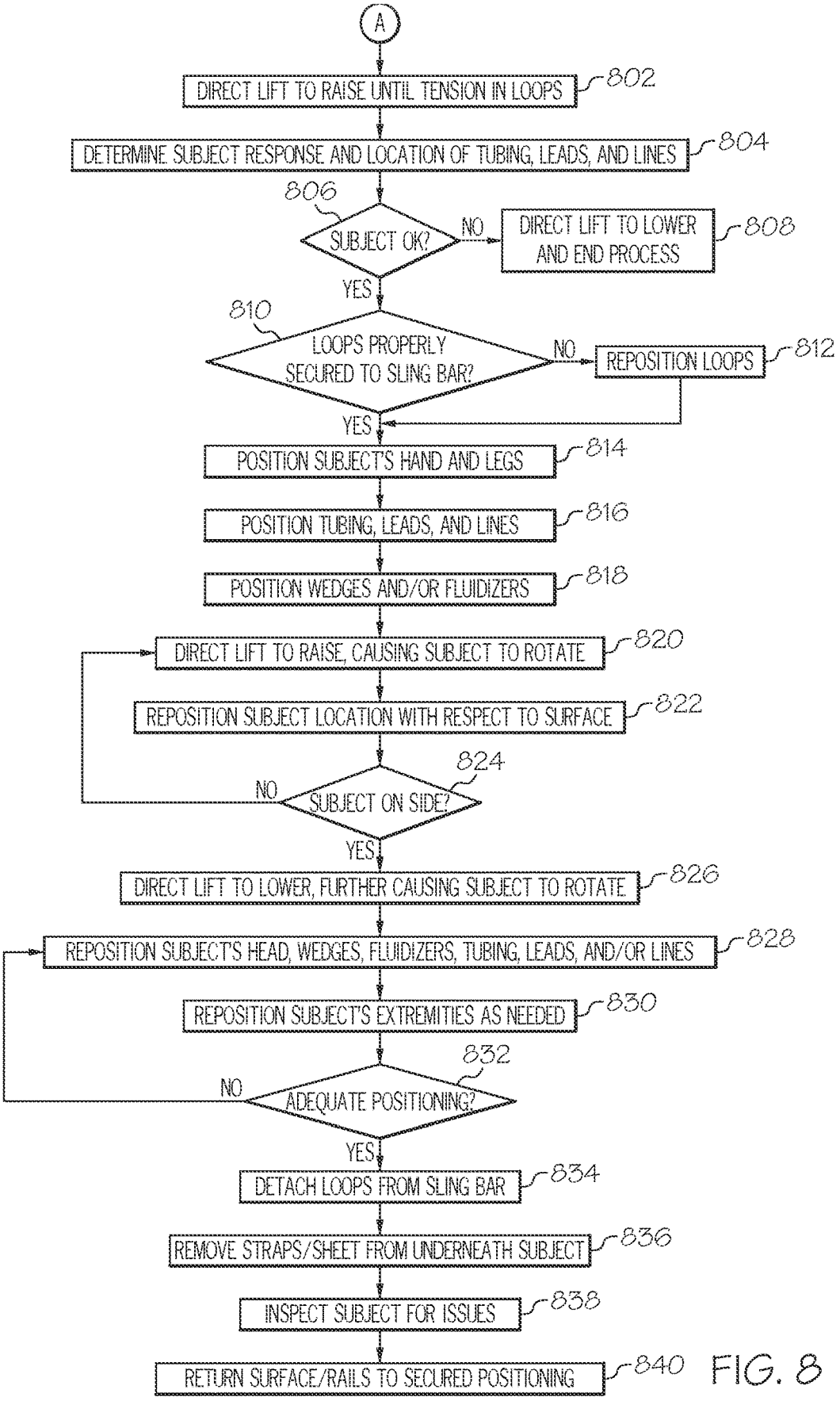
FIG. 8 depicts a flow diagram of an illustrative method of rotating a subject using an overhead lift according to one or more embodiments shown and described herein.

In the embodiments depicted in FIGS. 6A, 7A, and 7B, only one lift (not shown) and one sling bar 210 are depicted over the support surface 116 of the person support apparatus. That is, a single lift is used to facilitate rotation the subject 102. However, as previously discussed herein, a plurality of lifts may be used to facilitate rotation of the subject 102 in some embodiments. For example, FIGS. 6B and 7C depict use of two lifts, each having a respective sling bar 210*a*, 210*b*, that work in tandem to raise and lower over the support surface 116 of the person support apparatus 110 when actuated to facilitate rotation of the subject 102. That is, as shown in FIG. 6B, a first sling bar 210*a* may have a first retention component 222*a* thereof holding the second long loop 324*a* and a second retention component (hidden from view) thereof holding the first short loop (hidden from view) of the first multi-use strap 300*a*. A second sling bar 210*b* may have a first retention component 222*b* thereof holding the second long loop 324*b* and a second retention component (hidden from view) thereof holding the first short loop (hidden from view) of the second multi-use strap 300*b*. Similarly, in FIG. 7C, a first sling bar 210*a* may have a first retention component 222*a* thereof holding loop 352*b* of the lifting sheet 350 and a second retention component (hidden from view) holding loop 352*a* of the lifting sheet 350 (FIGS. 5C-5D, hidden from view in FIG. 7C). A second sling bar 210*b* may have a first retention component 222*b* thereof holding loop 352*f* of the lifting sheet 350 and a second retention component (hidden from view) holding loop 352*e* of the lifting sheet 350 (FIGS. 5C-5D, hidden from view in FIG. 7C). While loop 352*d* is shown not connected to either of the first sling bar 210*a* or the second sling bar 210*b*, it should be understood that loop 352*d* (as well as corresponding loop 352*c* hidden from view in FIG. 7C) may be connected to either of the first sling bar 210*a* or the second sling bar 210*b*.

Referring again to FIGS. 1 and 4, the subject 102 is now placed on the multi-use straps 300*a*, 300*b* (or alternatively the lifting sheet 350 shown in FIGS. 5C-5D), which is connected to the sling bar in an appropriate manner necessary for rotation. As such, the process proceeds at block 428 to point A in FIG. 8.

FIG. 8 depicts a flow diagram of an illustrative method of rotating a subject using an overhead lift (or plurality of overhead lifts), and FIGS. 9A-9F depict various points during the rotation process described with respect to FIG. 8. While FIGS. 9A-9F depict a scene using the first multi-use strap 300*a* and the second multi-use strap 300*b* and a single sling bar 210, it should be understood that other configurations, particularly those described herein, may also be used according to the processes described in FIG. 8. Further, while FIGS. 9A-9F depict the subject 102 being rotated from a supine position to a prone position, the subject may also be rotated from a prone position to a supine position using the same processes described with respect to FIG. 8.

Figure 9A:
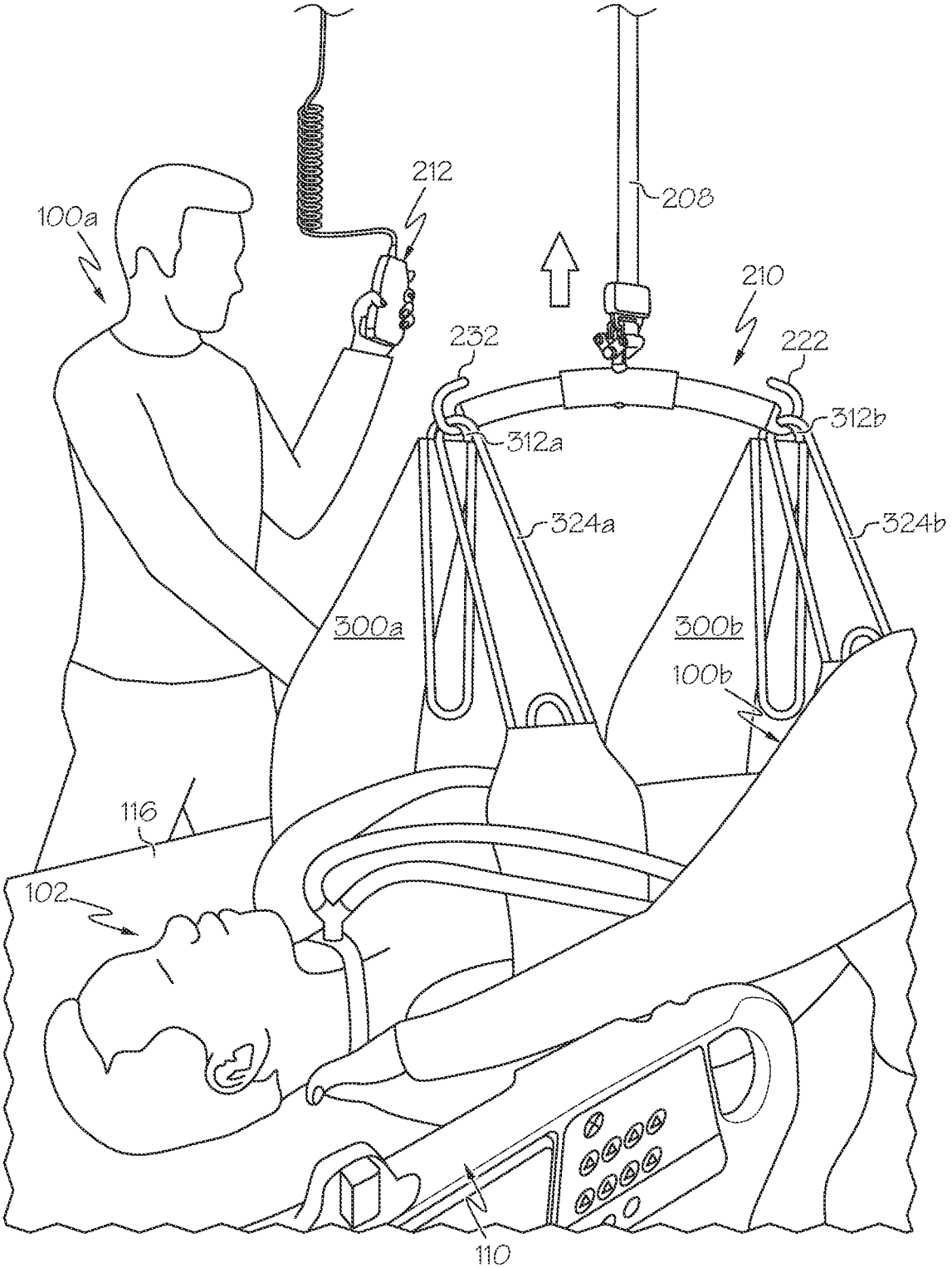
FIG. 9A schematically depicts an illustrative step of raising a lifting component in a method of rotating a subject using an overhead lift according to one or more embodiments shown and described herein.

Referring to FIGS. 8 and 9A, the lift is directed to raise the sling bar 210 until tension exists in the loops 312*a*, 312*b*, 324*a*, 324*b* at block 802. That is, the first individual 100*a* utilizes the hand control unit 212 to cause the lift (not shown) to retract the lifting strap 208 so that the sling bar 210 moves upwards, as indicated by the arrow in FIG. 9A.

Still referring to FIGS. 8 and 9A, at block 804, the individuals 100*a*, 100*b* determine the subject's 102 response (if any) and the location of the tubing, leads, lines, braces, and/or the like to ensure they are appropriately located, as described herein. At block 806, a determination may be made as to whether the subject 102 is in a condition for rotation ("subject ok?"). That is, the determination according to block 806 includes checking the airway of the subject 102 to ensure the subject 102 is breathing properly, verifying various other vital signs of the subject 102 are sufficient for rotation, checking connections of leads, tubing, lines, braces, and/or the like to make sure they have not become dislodged, kinked, damaged, or the like. If the subject is not in a condition for rotation (e.g., the response to "subject ok?" is no), the process may proceed to block 808. If the subject is in a condition for rotation (e.g., the response to "subject ok?" is yes), the process may proceed to block 810. At block 808, the lift is directed to lower the sling bar 210 and return the subject 102 to the original positioning and the process ends. Caretakers (e.g., the first individual 100*a* and/or the second individual 100*b*) may tend to the subject as needed. If rotation is to be reattempted, the processes according to FIGS. 4 and 8 may be repeated as necessary.

At block 810, a determination is made as to whether the loops 312*a*, 312*b*, 324*a*, 324*b* are properly secured to the sling bar 210. That is, the loops 312*a*, 312*b*, 324*a*, 324*b* and the retention components 222, 232 of the sling bar 210 are inspected to ensure that the loops 312*a*, 312*b*, 324*a*, 324*b* are appropriately placed around the respective retention components 222, 232 of the sling bar 210. In some embodiments, such a determination according to block 810 may further include ensuring that any locking mechanism present on the retention components 222, 232 is engaged. In some embodiments, such a determination according to block 810 may be part of a wider safety check that is completed as part of a particular facility's protocol, which may also include providing verbal confirmation that the loops 312*a*, 312*b*, 324*a*, 324*b* are properly secured to the respective retention components 222, 232 of the sling bar 210. If the loops 312*a*, 312*b*, 324*a*, 324*b* are not properly secured, the process moves to block 812. If the loops 312*a*, 312*b*, 324*a*, 324*b* are properly secured, the process moves to block 814. At block 812, the loops 312*a*, 312*b*, 324*a*, 324*b* may be repositioned on the respective retention components 222, 232 of the sling bar 210 so that the loops 312*a*, 312*b*, 324*a*, 324*b* are properly secured to the sling bar 210. Once the loops 312*a*, 312*b*, 324*a*, 324*b* are properly secured, the process moves to block 814.

At block 814, the hands and legs of the subject 102 are positioned for the rotating motion. For example, the arm of the subject 102 that is located on the "turn toward" side (e.g., the right side of the subject 102 in FIG. 9A) may be tucked underneath the hip or buttocks of the subject 102. Such tucking may act to help continue rotation of the subject 102 after the subject 102 is placed in a lateral recumbent position, as described in greater detail herein, because the arm acts as a pry that the subject 102 rotates over. The other arm of the subject 102 that is not located on the "turn toward" side (e.g., the left side of the subject 102 in FIG. 9A) may be placed alongside the torso of the subject 102. In another example, the legs of the subject 102 may be crossed, such as by crossing the leg opposite the "turn toward" side (e.g., the left leg of the subject 102 in FIG. 9A) on top of the other leg (e.g., the right leg of the subject 102 in FIG. 9A).

At block 816, the tubing, leads, lines, braces, and/or the like may be positioned. In some embodiments, the tubing, leads, lines, braces, and/or the like may be adjusted by temporarily disconnecting and/or removing the tubing, leads, lines, braces, and/or the like for the duration of the rotation process. In some embodiments, particularly embodiments where the tubing, leads, lines, braces, and/or the like cannot or should not be disconnected and/or removed, the tubing, leads, lines, braces, and/or the like may be moved to a position where they will not hinder rotation of the subject 102 and/or to a position where they will not or are less likely to become dislodged, kinked, disconnected, cause injury, and/or the like. In some embodiments, movement according to block 816 may be to the side of the person support apparatus 110 toward which the subject 102 will be turned (e.g., the "turn toward" side). It should be understood that block 816 is optional, particularly for some longer tubing, leads, lines, braces, and/or the like where it may not be necessary to move them or in instances where the tubing, leads, lines, braces, and/or the like have already been adjusted (e.g., according to block 418 in FIG. 4).

Still referring to FIGS. 8 and 9A, at block 818, one or more wedges, fluidizers, and/or the like may be positioned. That is, any device that is used to support the torso of the subject 102 when the subject 102 is in the prone position (when rotating the subject 102 from a supine position to a prone position as shown in FIGS. 9A-9F) may be placed. Still referring to FIGS. 8 and 9A, such wedges, fluidizers, and/or the like may be placed adjacent to the subject's 102 chest and stomach, for example. In some embodiments, pillows may be used in lieu of wedges and/or fluidizers. In some embodiments, positioning the wedges, fluidizers, and/or the like according to block 818 may be completed prior to the processes described herein with respect to blocks 820 and 822, as is depicted in FIG. 8. In other embodiments, positioning the wedges, fluidizers, and/or the like according to block 818 may be completed subsequent to the process described herein with respect to block 820, but prior to the process described herein with respect to block 822. In yet other embodiments, positioning the wedges, fluidizers, and/or the like according to block 818 may be completed subsequent to the processes described herein with respect to blocks 820 and 822.

Figure 9B:
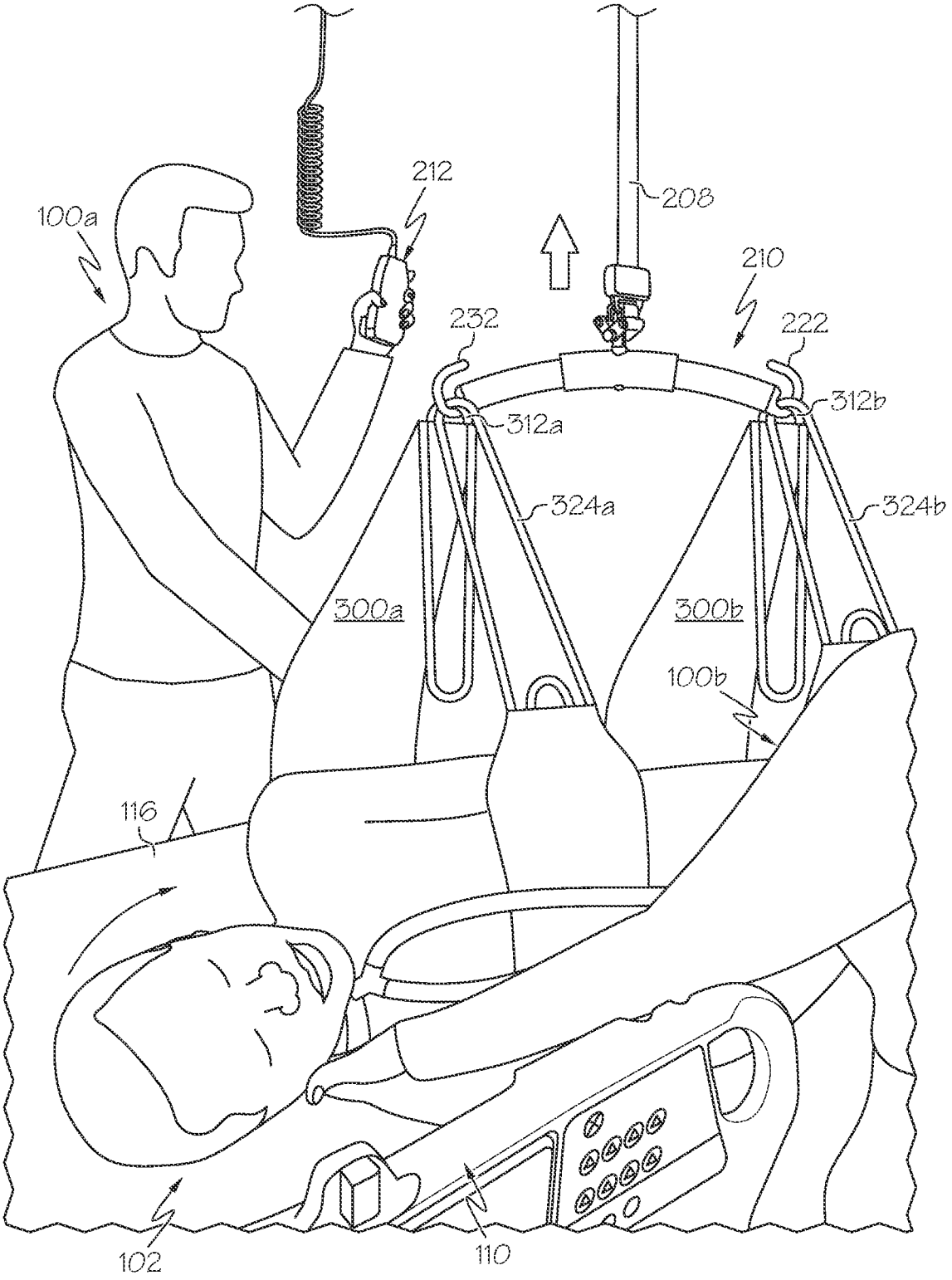
FIG. 9B schematically depicts illustrative rotation of a subject as a result of raising the lifting component as depicted in FIG. 9A according to one or more embodiments shown and described herein.

At block 820, the lift is directed to raise (e.g., take in the lifting strap 208) upon actuation of the hand control unit 212 by the first individual 100*a* (or alternatively the second individual 100*b*), which causes the sling bar 210 to move further upwards, as depicted in FIG. 9B. Because of the positioning of the subject with respect to the multi-use straps 300*a*, 300*b* and the specifically connected loops 312*a*, 312*b*, 324*a*, 324*b* to the respective retention components 222, 232 of the sling bar 210, the upward movement of the sling bar 210 (as indicated by the upwards pointing arrow in FIG. 9B) causes the subject 102 to rotate, as also depicted in FIG. 9B. That is, the subject 102 rotates from the supine positioning to a positioning whereby the right shoulder, right hip, right arm, right side of the torso, and the like of the subject 102 remain in contact with the support surface 116 of the person support apparatus 110 and the left shoulder, left hip, left arm, left side of the torso, and the like of the subject 102 are raised off the support surface 116 of the person support apparatus 110 to move the subject 102 towards a lateral recumbent position (e.g., a side-lying position). For example, FIG. 9C depicts the subject 102 in a right lateral recumbent position.

Figure 9C:
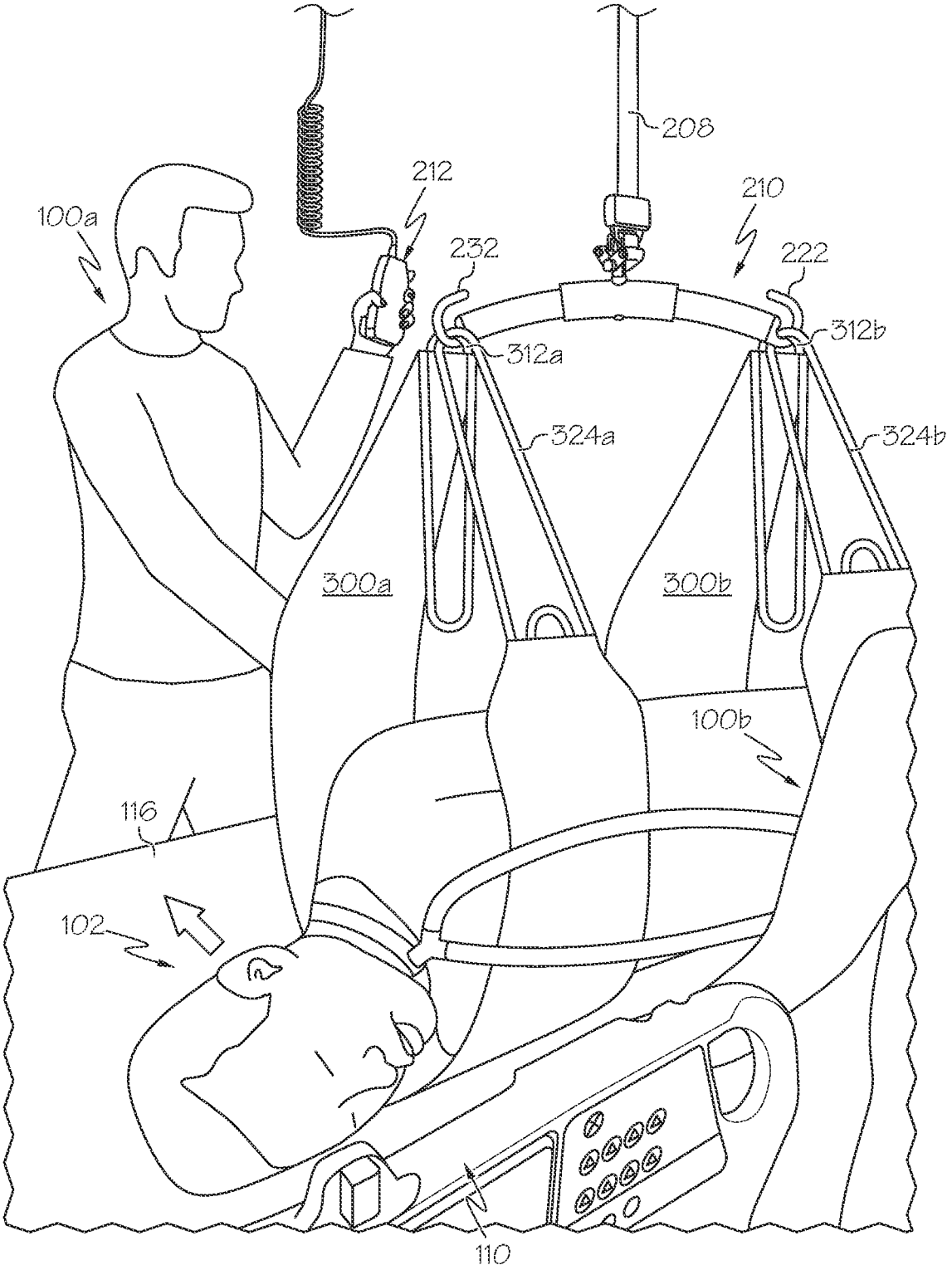
FIG. 9C schematically depicts an illustrative step of moving a partially rotated subject laterally on a surface in a method of rotating a subject using an overhead lift according to one or more embodiments shown and described herein.

Referring to FIGS. 8 and 9C, the subject 102 is repositioned with respect to the support surface 116 of the person support apparatus 110 at block 822. Such a repositioning generally includes moving the subject 102 laterally across the width of the support surface 116 in a direction opposite of the "turn toward" side. For example, in the embodiment depicted in FIG. 9C where the "turn toward" side of the person support apparatus 110 is the left hand side thereof, the subject 102 may be moved laterally toward the right hand side of the person support apparatus 110 as indicated by the arrow in FIG. 9C (e.g., toward the first individual 100*a* depicted in FIG. 9C). Such a repositioning generally occurs as the subject 102 is rotating from the supine position to the lateral recumbent position or once the subject 102 has rotated to the lateral recumbent position. Movement of the subject 102 in such a manner according to block 822 is generally completed to provide sufficient space on the support surface 116 of the person support apparatus 110 to complete the remaining rotational movements, as described hereinbelow.

Figure 9D:
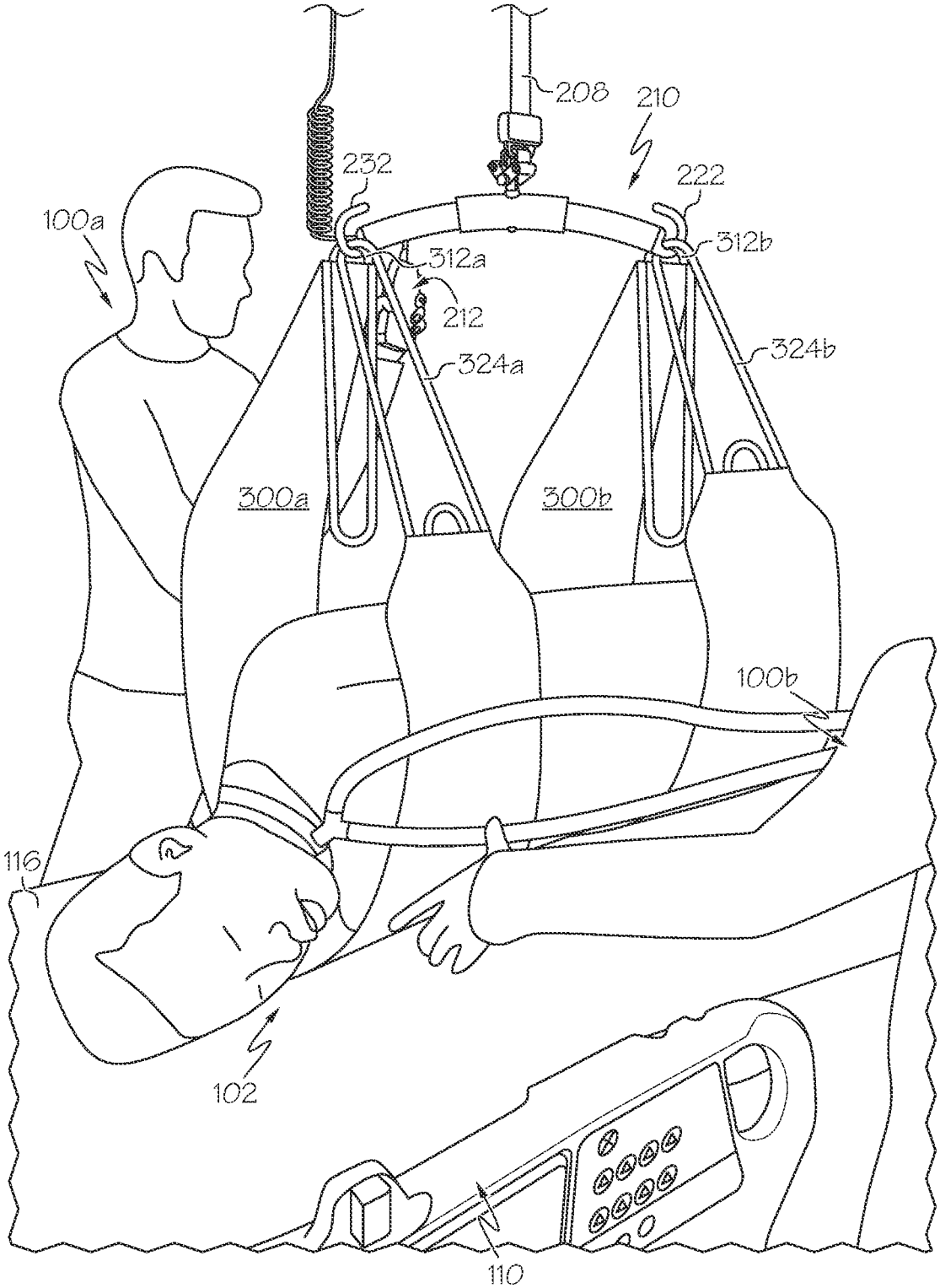
FIG. 9D schematically depicts an illustrative step of causing rotation of a subject by lowering a lifting component in a method of rotating a subject using an overhead lift according to one or more embodiments shown and described herein.

At block 824, a determination is made as to whether the subject 102 is lying on his or her side (e.g., in a lateral recumbent position), as depicted in FIG. 9D. Such a determination is completed to ensure that once the lift is directed to pay out the lifting strap 208 and cause the sling bar 210 to lower, the subject 102 will continue the rotation process toward a prone position and not revert to a supine position. If the subject 102 is not on his or her side (e.g., in a lateral recumbent position), the process may return to block 820 for further lifting and repositioning. If the subject 102 is on his or her side (e.g., in the lateral recumbent position), the process proceeds to block 826.

Figure 9E:
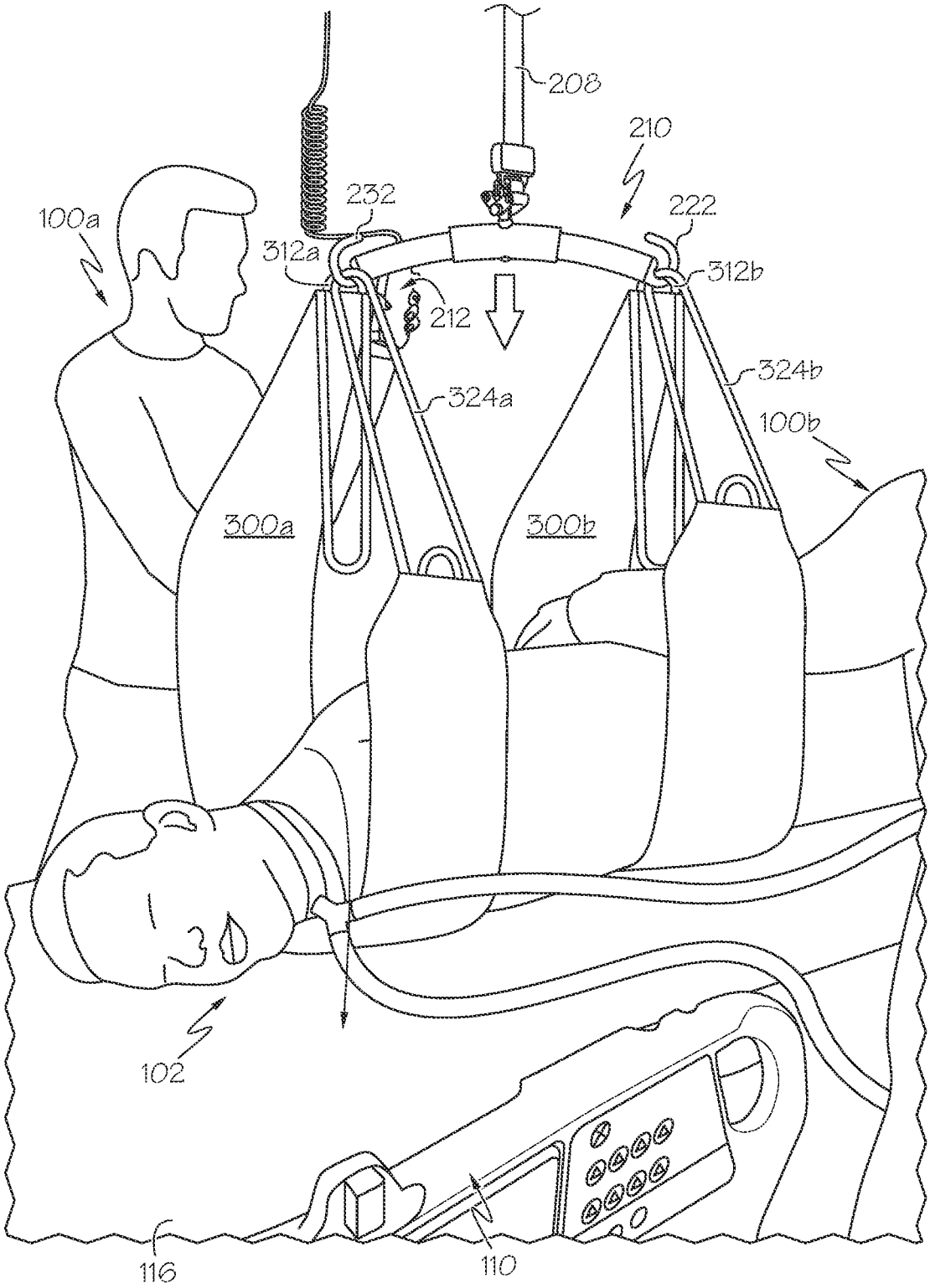
FIG. 9E schematically depicts further rotation of the subject of FIG. 9D as a result of lowering the lifting component according to one or more embodiments shown and described herein.
Figure 9F:
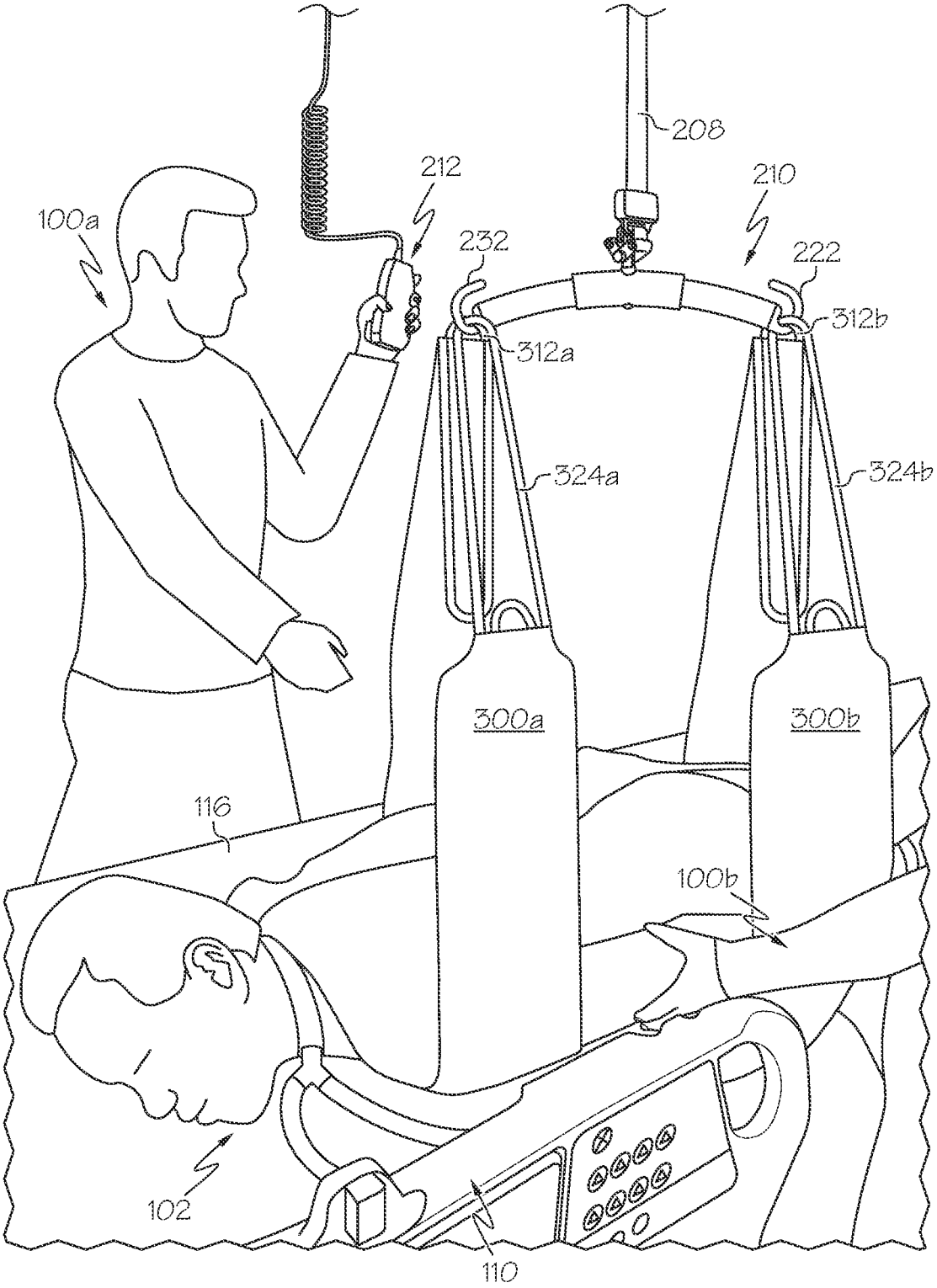
FIG. 9F schematically depicts an illustrative subject in a prone position as a result of a method of rotating the subject using an overhead lift according to one or more embodiments shown and described herein.

Referring now to FIGS. 8 and 9E, the lift is directed to lower, causing further rotation of the subject 102 at block 826. That is, a user (e.g., the first individual 100*a*) utilizes the hand control unit 212 to cause the lift to pay out the lifting strap 208, which causes the sling bar 210 to move downwards, as depicted by the downward pointing arrow in FIG. 9E. The downward movement of the sling bar 210 causes the subject 102 to rotate, as depicted by the rotating arrow in FIG. 9B. That is, the subject 102 rotates from the side laying (e.g., lateral recumbent) positioning towards a prone position. The subject 102 in the prone position is depicted in FIG. 9F. In some embodiments, intervention from one or more caretakers (e.g., the first individual 100*a* and/or the second individual 100*b*) may also be provided during downward movement to ensure appropriate rotation of the subject 102 toward the prone position.

It should be appreciated that the processes described herein with respect to blocks 822-824 are optional, particularly in embodiments where the subject 102 is positioned to be offset a relatively greater distance from the midline 504 of the multi-use straps 300*a*, 300*b* depicted in FIG. 5A or the midline 506 of the lifting sheet 350 depicted in FIG. 5C (e.g., greater than the 15 cm/6 inches off center positioning described hereinabove, such as the 61 cm/24 inches off center positioning described above). That is, in such embodiments, the subject 102 may rotate a full 180° (e.g., from supine to prone or from prone to supine) via a raising of the lift according to block 820 in such a positioning. As such, it may not be necessary to reposition the subject 102 or determine if the subject 102 is on his or her side according to blocks 822 and 824 and the lift may be directed to lower according to block 826 to place the fully rotated subject 102 back on the support surface 116.

Referring to FIGS. 8 and 9F, once the subject 102 is in the prone position, the head of the subject 102, any wedges, fluidizers, tubing, leads, lines, braces, and/or the like may be repositioned at block 828. For example, wedges, fluidizers, pillows, and/or the like may be adjusted such that they support the torso of the subject 102, the hips of the subject 102, the shoulder areas of the subject 102, and/or the like. In another example, the head of the subject and/or various tubing (e.g., a tracheostomy tube or the like) may be repositioned to prevent dislodgement, disruption, kinking, or the like. In yet another example, lines, tubing, leads, braces, dressing, or the like may be adjusted or reposition to prevent dislodgement or the like.

At block 830, various extremities of the subject 102 may be positioned in some embodiments. For example, extremities that were tucked or crossed (e.g., tucked arms, crossed legs, or the like) may be untucked or uncrossed. It should be understood that the processes may be completed while a user controlling the lift (e.g., the first individual 100*a*) maintains control in the event that lifting or lowering is necessary during this process (e.g., slightly lifting the sling bar 210 to raise the subject 102 slightly to remove an arm tucked under the subject 102). Maintaining control may include maintaining a grasp on the hand control unit 212 in some embodiments.

At block 832, a determination is made as to whether the subject 102 is adequately positioned. That is, the subject 102 may be observed to ensure that all extremities are appropriately positioned, the head is appropriately positioned, the various support components (wedges, fluidizers, pillows, or the like) are appropriately placed, wires, leads, tubes, and/or the like are appropriately positioned, and/or the like. If adequate positioning is not observed, the process may return to block 828. If adequate positioning is observed, the process proceeds to block 834.

At block 834, the loops 312*a*, 312*b*, 324*a*, 324*b* are detached from the respective retention components 222, 232 of the sling bar 210. The multi-use straps 300*a*, 300*b* (or alternatively the lifting sheet 350 of FIGS. 5C-5D) are then removed from underneath the subject at block 836. In some embodiments, a friction-reducing device (FRD) may be used to facility removal of the multi-use straps 300*a*, 300*b*, particularly in instances where there may be concerns regarding the subject's 102 skin. In some embodiments, removal of the multi-use straps 300*a*, 300*b* may not be necessary. For example, the multi-use straps 300*a*, 300*b* may be used to rotate the subject more than once, and it may be desirable to leave the multi-use straps 300*a*, 300*b* in place for future rotating. In such embodiments, removal of the multi-use straps 300*a*, 300*b* according to block 836 may be omitted.

At block 838, the subject 102 is once again inspected for issues. Further, at block 840, the side rails 120 may be returned to their raised positions and the person support apparatus 110 may be lowered to the standard secured positioning, thereby ending the process.

It should now be understood that the present disclosure relates to methods of rotating a subject from a prone position to a supine position and/or from a supine position to a prone position using one or more overhead lifts and particularly positioned multi-use straps or a lifting sheet that are arranged with respect to the subject and are connected to a sling bar of the overhead lift in a particular manner to facilitate the rotating process without requiring a large physical effort by the caregivers relative to other manual proning or supining processes.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method of rotating, in a direction of rotation, a horizontally laying subject in a first orientation on a support surface, the method comprising:

arranging at least one lifting aid to extend in a lateral direction underneath the subject such that a midline of the subject is located off center from a centerline of the lifting aid in a direction opposite the direction of rotation, the lifting aid comprising a first end extending laterally toward the direction of rotation and a second end extending laterally toward the direction opposite the direction of rotation, the first end comprising at least one first loop and the second end comprising at least one second loop;

connecting the at least one first loop and the at least one second loop to a sling bar coupled to an overhead lift;

directing the overhead lift to raise the sling bar, wherein the subject rotates with respect to the lifting aid towards the direction of rotation as the overhead lift raises the sling bar due to the off center location of the subject and the lengths of the first loop and the second loop;

repositioning the subject with respect to the support surface when the subject has rotated to a lateral recumbent position; and directing the overhead lift to lower the sling bar, thereby causing the subject to continue rotating with respect to the lifting aid to a second orientation that is 180° from the first orientation.

2. The method of claim 1, wherein arranging the at least one lifting aid comprises arranging a plurality of multi-use straps or a lifting sheet.

3. The method of claim 1, wherein the first orientation is a prone position and the second orientation is a supine position.

4. The method of claim 1, wherein the first orientation is a supine position and the second orientation is a prone position.

5. The method of claim 1, wherein connecting the at least one first loop and the at least one second loop to the sling bar comprises connecting the at least one first loop to a first retention component of the sling bar and connecting the at least one second loop to a second retention component of the sling bar.

6. The method of claim 1, wherein the at least one first loop comprises a plurality of first loops and the at least one second loop comprises a plurality of second loops.

7. The method of claim 6, further comprising connecting one loop of the plurality of first loops and one loop of the plurality of second loops to a second sling bar coupled to a second overhead lift.

8. The method of claim 1, wherein arranging the at least one lifting aid comprises arranging an upper edge of the at least one lifting aid such that the upper edge is longitudinally positioned at a location between a shoulder and an armpit of the subject.

9. The method of claim 1, wherein arranging the at least one lifting aid comprises arranging the at least one first loop and the at least one second loop such that at least one first loop and the at least one second loop are longitudinally aligned with a location between a shoulder and an armpit of the subject.

10. The method of claim 1, wherein arranging the at least one lifting aid comprises arranging an upper edge of the at least one lifting aid such that the upper edge is longitudinally positioned at a location that is from 1 cm to 15 cm in an inferior direction from a top of a shoulder of the subject.

11. The method of claim 1, wherein arranging the at least one lifting aid comprises arranging the at least one first loop and the at least one second loop such that at least one first loop and the at least one second loop are longitudinally aligned with a location that is from 1 cm to 15 cm in an inferior direction from a top of a shoulder of the subject.

12. The method of claim 1, wherein arranging the at least one lifting aid comprises arranging a lower edge of the at least one lifting aid such that the lower edge is longitudinally positioned at a location between a waist and a knee of the subject.

13. The method of claim 1, wherein arranging the at least one lifting aid comprises arranging a lower edge of the at least one lifting aid such that the lower edge is longitudinally positioned at a location that corresponds to a greater trochanter of the subject.

14. The method of claim 1, further comprising positioning one or more of the subject's arms and legs prior to directing the overhead lift to raise the sling bar.

15. The method of claim 1, further comprising positioning one or more of a wedge and a fluidizer with respect to the subject prior to directing the overhead lift to raise the sling bar.

16. The method of claim 1, further comprising positioning one or more of a wedge and a fluidizer with respect to the subject prior to directing the overhead lift to lower the sling bar.

17. The method of claim 1, wherein repositioning the subject comprises sliding the subject laterally across the support surface in a direction that is away from the direction of rotation.

18. The method of claim 1, further comprising adjusting one or more of tubing, leads, lines, and braces.

19. A method of rotating a subject laying horizontally in a first orientation on a support surface, the method comprising:

directing an overhead lift to raise a sling bar supporting a plurality of first loops and a plurality of second loops of a plurality of multi-use straps positioned under the subject on the support surface, the plurality of multi-use straps extending laterally such that a midline of the subject is located off center from a centerline of the plurality of multi-use straps in a direction that is opposite a direction of rotation, each of the plurality of multi-use straps having a first end extending in the direction of rotation and a second end extending in the direction that is opposite the direction of rotation, the first end of each of the plurality of multi-use straps comprising a first loop of the plurality of first loops and the second end of the plurality of multi-use straps comprising a second loop of the plurality of second loops, wherein the subject rotates with respect to the lifting aid towards the direction of rotation as the overhead lift raises the sling bar due to the off center location of the subject;

repositioning the subject with respect to the support surface when the subject has rotated to a lateral recumbent position; and directing the overhead lift to lower the sling bar, thereby causing the subject to continue rotating with respect to the lifting aid to a second orientation that is 180° from the first orientation.

20. A method of rotating a subject laying horizontally in a first orientation on a support surface, the method comprising:

directing an overhead lift to raise a sling bar supporting a plurality of first loops and a plurality of second loops of a lifting sheet positioned under the subject on the support surface, the lifting sheet extending laterally such that a midline of the subject is located off center from a centerline of the lifting sheet in a direction that is opposite a direction of rotation, the lifting sheet having a first side edge extending laterally toward the direction of rotation and a second side edge extending laterally toward the direction that is opposite the direction of rotation, the first side edge comprising the plurality of first loops and the second side edge comprising the plurality of second loops, wherein the subject rotates with respect to the lifting aid towards the direction of rotation as the overhead lift raises the sling bar due to the off center location of the subject;

repositioning the subject with respect to the support surface when the subject has rotated to a lateral recumbent position; and directing the overhead lift to lower the sling bar, thereby causing the subject to continue rotating with respect to the lifting aid to a second orientation that is 180° from the first orientation.

* * * * *